US010597817B2

(12) United States Patent
Greeson, Jr. et al.

(10) Patent No.: US 10,597,817 B2
(45) Date of Patent: Mar. 24, 2020

(54) BALANCE OF DURABLE PRESS PROPERTIES OF COTTON FABRICS USING NON-FORMALDEHYDE TECHNOLOGY

(71) Applicant: COTTON, INC., Cary, NC (US)

(72) Inventors: Harold Kenneth Greeson, Jr., Raleigh, NC (US); Guan Wang, Newark, DE (US); Mary Ann Ankeny, Raleigh, NC (US)

(73) Assignee: Cotton, Inc., Cary, NC (US)

( * ) Notice: Subject to any disclaimer, the term of this patent is extended or adjusted under 35 U.S.C. 154(b) by 0 days.

(21) Appl. No.: 16/129,185

(22) Filed: Sep. 12, 2018

(65) Prior Publication Data

US 2019/0078255 A1 Mar. 14, 2019

Related U.S. Application Data

(60) Provisional application No. 62/699,920, filed on Jul. 18, 2018, provisional application No. 62/557,311, filed on Sep. 12, 2017.

(51) Int. Cl.

| | |
|---|---|
| ***D06M 13/352*** | (2006.01) |
| ***D06M 13/432*** | (2006.01) |
| ***D06M 13/46*** | (2006.01) |
| ***D06M 15/227*** | (2006.01) |
| ***D06M 15/643*** | (2006.01) |
| ***D06M 11/155*** | (2006.01) |
| ***D06M 11/17*** | (2006.01) |
| ***D06M 13/192*** | (2006.01) |
| ***D06M 13/188*** | (2006.01) |
| *D06M 101/06* | (2006.01) |

(52) U.S. Cl.

CPC ..... *D06M 13/352* (2013.01); *D06M 13/432* (2013.01); *D06M 13/46* (2013.01); *D06M 11/155* (2013.01); *D06M 11/17* (2013.01); *D06M 13/188* (2013.01); *D06M 13/192* (2013.01); *D06M 15/227* (2013.01); *D06M 15/6436* (2013.01); *D06M 2101/06* (2013.01); *D06M 2200/20* (2013.01); *D06M 2200/35* (2013.01); *D06M 2200/45* (2013.01); *D06M 2200/50* (2013.01)

(58) Field of Classification Search

CPC .. D06M 13/352; D06M 13/432; D06M 13/46; D06M 15/227; D06M 15/6436; D06M 13/192; D06M 13/188; D06M 11/155; D06M 11/17; D06M 2101/06; D06M 2200/20; D06M 2200/35; D06M 2200/45; D06M 2200/50

See application file for complete search history.

(56) References Cited

U.S. PATENT DOCUMENTS

| | | | | |
|---|---|---|---|---|
| 2,886,474 | A | 5/1959 | Kine et al. | |
| 3,232,691 | A | 2/1966 | Wilhelm et al. | |
| 3,957,431 | A | 5/1976 | Pai et al. | |
| 4,331,438 | A | 5/1982 | Pai | |
| 5,352,372 | A | 10/1994 | North | |
| 5,707,404 | A | 1/1998 | Andrews et al. | |
| 8,399,692 | B2 | 3/2013 | Krafft et al. | |
| 2006/0234903 | A1* | 10/2006 | Short | D06M 13/192 510/526 |
| 2013/0280432 | A1* | 10/2013 | Johnson | C09K 21/04 427/381 |

FOREIGN PATENT DOCUMENTS

| | | | |
|---|---|---|---|
| CN | 10178181 | * 11/2007 | D06M 15/564 |
| CN | 100549271 | 10/2009 | |
| GB | 768883 | 2/1957 | |
| GB | 769252 | 3/1957 | |
| GB | 769255 | 3/1957 | |
| GB | 769271 | 3/1957 | |
| GB | 1142428 | 2/1969 | |
| KR | 10-2002-0042287 | 6/2002 | |
| WO | WO 2007/042380 | 4/2007 | |
| WO | WO 2015/144600 | 10/2015 | |
| WO | WO 2019/055502 | 3/2019 | |

OTHER PUBLICATIONS

ASTM International, Standard Performance Specification for Men's and Women's Dress and Vocational Career Apparel Fabrics, 4 pages, retrieved Oct. 29, 2019.

COTTON, Internal Test Method Modification of ASTM D4966 for Use in Evaluation of Tough Cotton Knits, 1 page, retrieved Oct. 29, 2019.

European Chemicals Agency, Formaldehyde and formaldehyde releasers—Strategy for future work, Jan. 11, 2018, 11 pages.

Greeson et al., Tough Cotton Finish for Shirting. AATCC Review. Mar. 2009, 9:30-32.

Greeson et al., Tough Cotton: A Novel Approach to Durable Press Finishing. AATCC Review, Mar. 2005, 5:13-16.

Tomasino, Chemistry & Technology of Fabric Preparation & Finishing, North Carolina State University, 1992, 266 pages.

Vigo, Textile Processing and Properties Preparation, Dyeing, Finishing and Performance, 1994, Elsevier Science B.V., Amsterdam, The Netherlands, TOC Only.

International Search Report and Written Opinion for PCT/US2018/050648, dated Mar. 25, 2019, 11 pages.

* cited by examiner

*Primary Examiner* — Amina S Khan

(74) *Attorney, Agent, or Firm* — Casimir Jones, S.C.; Jeffrey W. Childers

(57) ABSTRACT

A formulation for durable press finishing of a cellulosic substrate, or a blend thereof, in a finish bath, the formulation comprising from about 3.0% to about 60.0% by weight of non-formaldehyde dimethylurea/glyoxal (DMUG), or an analog thereof, and from about 0.1% to about 4.0% by weight of one or more additives selected from dicyandiamide, choline chloride, ethyleneurea, propyleneurea, urea, dimethylurea, and combinations thereof, wherein the percent by weight is given in terms of percent weight of the finish bath, and wherein the formulation is substantially free of dimethyloldihydroxyethyleneurea (DMDHEU), and methods of use thereof.

42 Claims, No Drawings

BALANCE OF DURABLE PRESS PROPERTIES OF COTTON FABRICS USING NON-FORMALDEHYDE TECHNOLOGY

CROSS-REFERENCE TO RELATED APPLICATIONS

This application claims the benefit of U.S. Provisional Application Nos. 62/557,311, filed Sep. 12, 2017, and 62/699,920, filed Jul. 18, 2018, each of which is incorporated herein by reference in its entirety.

BACKGROUND

Cotton fabrics are often treated with crosslinking resins (also referred to as "reactants") to impart wrinkle resistance during wear and after multiple launderings. The crosslinking not only imparts durable smoothness and shape retention to the fabrics, but also improves shrinkage control and inhibits pilling and fuzzing of the fabric surface. Other benefits of crosslinking include, but are not limited to, quicker drying and easier pressing, where that may be necessary.

The crosslinking process, however, also has some disadvantages. There is a loss of abrasion resistance and strength, which results in a decreased wear life. A number of methods have been developed over the years to lessen the impact of these deteriorating effects. Some of these technologies have been adopted while other proposed methods have been too expensive.

Many of the commercial reactants that are used to impart wrinkle resistance also have the disadvantage of releasing formaldehyde, either during the mixing and application of such reactants in the textile mill, or after they have been applied to fabric. In recent years, the World Health Organization (WHO) has classified formaldehyde as carcinogen (International Agency for Research on Cancer (IRAC), Press Release No. 153, Jun. 15, 2004). Recently, the European Chemicals Agency (ECHA) released the following statement, "Formaldehyde is classified as category 1B carcinogen with a CLP concentration limit of ≥0.1%1. The Commission has proposed to include formaldehyde and some formaldehyde releasers in the next amendment to Annex XVII to include CMR substances 1A and 1B in the Appendixes to restriction entries 28-30 to Annex XVII. This will restrict the placing on the market for supply to the general public of formaldehyde and included formaldehyde releasers in mixtures with the respective concentration limits set by the CLP regulation will be included." Available at: www.echa.europa.eu/documents/10162/13641/formaldehyde_review_report_en.pdf/5 51df4a2-28c4-2fa9-98ec-c8d53e2bf0fc.

Over the years, reactants, such as dimethyloldihydroxyethyleneurea (DMDHEU), have been modified to lessen the release of formaldehyde, but these products are not completely free of formaldehyde. See, e.g., B. Li, Y. Dong, P. Wang, and G. Cui, *Release behavior and kinetic evaluation of formaldehyde from cotton clothing fabrics finished with DMDHEU-based durable press agents in water and synthetic sweat solution*, Textile Research Journal, Vol 86 (16), 1738-1749 (2016).

Several non-formaldehyde reactants have been developed and tested over time, but many have drawbacks in terms of yellowing, latent odor development on fabric, cost, or poor performance. Recently, reactants that are based on modified dimethylurea/glyoxal (DMUG) chemistry have been developed and applied in a fashion to achieve wrinkle resistance comparable to DMDHEU without formaldehyde release or the aforementioned drawbacks of yellowing and latent odor. The use of modified DMUG chemistry alone, however, does not solve the problem of loss of abrasion resistance and strength associated with non-formaldehyde reactants.

SUMMARY

In some aspects, the presently disclosed subject matter demonstrates that the strength and abrasion losses associated with the application of modified DMUG non-formaldehyde reactants can be alleviated with the addition of selected chemicals to the treatment bath. Among the compounds found to be useful include dicyandiamide, choline chloride, ethyleneurea, propyleneurea, urea, and dimethylurea. These chemicals must be added at the correct concentration in an optimized finishing formulation to achieve the desired effects.

Accordingly, in some aspects, the presently disclosed subject matter provides a formulation for finishing a cellulosic substrate, or a blend thereof, in a finish bath, the formulation comprising from about 3.0% to about 60.0% by weight of non-formaldehyde dimethylurea/glyoxal (DMUG), or an analog thereof, and from about 0.1% to about 4.0% by weight of one or more additives selected from dicyandiamide, choline chloride, ethyleneurea, propyleneurea, urea, dimethylurea, and combinations thereof, wherein the percent by weight is given in terms of percent weight of the finish bath, and wherein the formulation is substantially free of dimethyloldihydroxyethyleneurea (DMDHEU).

In other aspects, the presently disclosed subject matter provides a method for finishing a durable-press cellulosic substrate, or a blend thereof, in a finish bath, the method comprising applying a finishing formulation comprising from about 3.0% to about 60.0% by weight of non-formaldehyde dimethylurea/glyoxal (DMUG), or an analog thereof, and from about 0.1% to about 4.0% by weight of one or more additives selected from dicyandiamide, choline chloride, ethyleneurea, propyleneurea, urea, dimethylurea, and combinations thereof, wherein the percent by weight is given in terms of percent weight of the finish bath, and wherein the formulation is substantially free of dimethyloldihydroxyethyleneurea (DMDHEU), to the substrate for a period of time at an elevated temperature.

In certain aspects, the cellulosic substrate comprises a cellulosic fiber selected from cotton, jute, flax, hemp, ramie, regenerated cellulose products (including, but not limited to, rayon (viscose), lyocell, and modal), and blends thereof. In particular aspects, the cellulosic substrate comprises cotton or a cotton blend. In other aspects, the cellulosic substrate comprises one or more non-cellulosic fibers. In particular aspects, the non-cellulosic fiber is selected from a polyolefin, a polyester, nylon, polyvinyl, polyurethane, acetate, a mineral fiber, silk, wool, polylactic acid (PLA), or polytrimethyl terephthalate (PTT), and combinations thereof.

In certain aspects, the cellulosic substrate comprises an article selected from a woven fabric, a knit fabric, a non-woven fabric, a multilayer fabric, a garment, and a yarn.

Certain aspects of the presently disclosed subject matter having been stated hereinabove, which are addressed in whole or in part by the presently disclosed subject matter, other aspects will become evident as the description proceeds when taken in connection with the accompanying Examples as best described herein below.

DETAILED DESCRIPTION

The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and Examples. Therefore, it is to be understood that the presently disclosed subject matter is not to be limited to the specific embodiments disclosed and that modifications and other embodiments are intended to be included within the scope of the appended claims.

A. Overview of Cotton-Containing Durable Press Garments

A number of variables must be addressed to obtain acceptable performing properties for cotton-containing durable press garments. The structural, mechanical, chemical, aesthetic, cost, and marketing of the product require intense consideration. The presently disclosed subject matter addresses, in part, factors important for appearance and wear life of cotton-containing durable press garments.

Before a fabric can be considered for durable press processing, it must be properly constructed to tolerate the expected strength loss and still meet the end use requirements. The cotton fiber selected must be acceptable with respect to strength, staple length, and micronaire (a measure of the air permeability of cotton fibers). The strength of the yarn made from the selected cotton will be influenced by the method of spinning, as well as the twist and size. For the fabric itself, the strength will depend on the density and distribution of the yarns in the construction.

Preparation exerts a significant influence on the final properties of the cotton-containing durable press product. Open width processing is preferred to avoid setting permanent wrinkles into the fabric. Care must be taken in bleaching to avoid weakening by over-oxidation and pinholes due to localized activation of the bleach by iron oxide and other metal compounds. Mercerization is often performed to obtain immature cotton coverage during dyeing, to enhance fabric strength, and for improved luster. Some laboratory experiments, however, indicate that a very high degree of mercerization may have an adverse influence on abrasion resistance, most likely due to an increase in stiffness of the fabric.

Further, in dyeing, it is important to obtain good penetration of the colorant. Otherwise, the loss in abrasion resistance will be made more obvious. Some important considerations include dye selection and method of dyeing. Piece dyeing permits better penetration than continuous dyeing. Pad batch dyeing is sometimes practiced to avoid ring dyeing of the cotton.

Various pretreatments before chemical finishing on cotton fabric have been explored to improve the balance of physical properties on the final product. Some of these techniques have included grafting various monomers onto the cotton and wet fixation of formaldehyde-containing resins. Such methods have been expensive and marginally successful. The most dramatic improvements have been realized by pre-treating with anhydrous liquid ammonia. Although expensive and requiring special equipment, the process not only improves abrasion resistance, it also improves the aesthetic properties of the finished cotton, such as hand and drapability.

Mechanical methods also have been effective in improving the strength retention of the cotton-containing durable press product. One such process is the micro-stretch technique. In the micro-stretch technique, the fabric is stretched in the width direction and held there until crosslinking takes place. There is an increase in the filling strength, but not in the warp. This increase is probably due to a better alignment of the structural components of the filling yarns. There is not, however, an improvement in abrasion resistance by this process. Some of the disadvantages of this approach also include loss of crimp in the filling direction, less coverage of the fabric, and extra care in processing.

The normal method of applying the durable press finish to cotton fabrics is pad-dry-cure where a wet pickup of between about 60 percent to about 100 percent is obtained depending on the fabric. The curing process may be performed simultaneously along with the pad-dry process (i.e., "pre-cure" or "flash cure") or may be performed after the fabric is cut and sewn into garment form followed by pressing to form creases or pleats (i.e., "post-cure" or "delayed cure"). If the wet pickup is reduced to about 35%, there can be a small, but significant, increase in the abrasion resistance. Some of the methods found useful for this purpose, as well as for energy conservation are foam, vacuum, engraved roll, and spray. By placing more of the resin used on the backside of the fabric with these methods, further benefits in abrasion resistance have been realized.

In addition to the pad-dry process, there is an alternative method for durable press finishing of cotton fabrics called "moist cure" or "moist crosslinking" (herein the process will be referred to as "moist cure".) In the moist cure process, a durable press finish that contains a crosslinking agent, such as DMDHEU, and a highly acidic catalyst (normally based on hydrochloric acid or sulfuric acid) is applied at very low pH (usually in the range of 1.0 to 2.0) at a wet pickup between 60 percent and 100 percent. The fabric is then carefully dried to a residual moisture content, normally in the range of 6 percent to 12 percent. The fabric is then rolled onto an A-frame or similar device, which is then stored at a constant temperature of about 30-35° C. for 16 to 24 hours. The fabric is then neutralized and washed to remove the acidity, followed by drying. The treatment bath may contain a lubricant, such as polyethylene or silicone emulsions (carefully selected for highly acid conditions). The fabric is often pre-softened or post-softened to improve processability or fabrics aesthetics (such as handle).

In the durable press finish itself, considerable attention over the years has been directed at the crosslinking agent. The compound that has satisfied most of the requirements of performance, safety, availability, and cost has been dimethyloldihydroxyethyleneurea (DMDHEU).

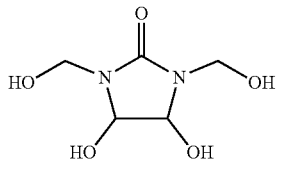

DMDHEU

DMDHEU is most commonly used in the etherified form to control the free formaldehyde. It also may be buffered or unbuffered.

Alternatives to DMDHEU include selected polycarboxylic acids that are totally formaldehyde free, but such polycarboxylic acids lack the performance and cost advantages of the DMDHEU. They also required the use of sodium hypophosphite as the catalyst, which can cause excessive shade change with certain dye types, is expensive, and is closely regulated by the government because it is a raw material for certain illegal drugs. Another type of non-formaldehyde resin is the reaction product of dimethylurea and glyoxal (DMUG).

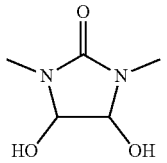

DMUG

Historically, DMUG lacked the performance of the DMDHEU, but recent chemical modifications to the DMUG and other procedural changes have led to better performance.

Over the years many catalysts have been used. Today with regard to performance and safety, magnesium chloride or magnesium chloride activated with citric acid, acetic acid, or hydroxyacetic acid are mostly used. Other catalysts have included aluminum chloride, magnesium sulfate, and other similar salts, with or without an organic acid blended into the formulation. As mentioned hereinabove, for moist cure, catalyst based upon strong mineral acids, such as hydrochloric acid or sulfuric acid, may be used under specialized conditions. For the selected polycarboxylic acid crosslinkers, sodium hypophosphite is commonly recommended.

The concentrations of the resin and catalyst and the temperature and time of the reaction with the cotton-containing fabric play a dramatic role in the durable press, strength, and abrasion resistance of the finished product. Sufficient resin and catalyst are necessary for adequate durable press, but too much resin and/or catalyst will result in excessive strength and abrasion resistance loss. In the same manner, excessive temperature and/or time of cure can result in undue loss of strength and abrasion resistance. These parameters must be optimized to achieve the maximum benefit from a particular finish.

Softeners are essential components of every durable press finish. They play an important role in the hand, needle cut resistance, and abrasion resistance. Although softeners improve the tear strength, they decrease the tensile strength because they permit slippage of fibers and yarns. Polyethylene, in particular, helps to improve the abrasion resistance. This property is due to the lubricity of the polymer and its durability to washing. Durability may be further enhanced by the addition of a low level of a surface crosslinker, such as polyfunctional blocked isocyanate.

B. Improving the Balance of Durable Press Properties of Cotton Fabrics Using Non-Formaldehyde Technology The presently disclosed subject matter, in part, demonstrates that other additives may be used in the finishing formulation, e.g., a finishing formulation comprising DMUG, to improve the strength and abrasion resistance of cotton-containing durable press products. As provided herein below, it is critical that the additives be used in an optimized finish at the correct concentrations. If the concentration of a particular additive is too low, it will not be effective. If the concentration of a particular additive is too high, it will adversely affect the durable press performance. Representative additives include dicyandiamide, choline chloride, ethyleneurea, propyleneurea, urea, and dimethylurea. The concentration of each additive can vary from about 0.1% to about 4.0% by weight of the finish bath depending on the finishing bath and the particular additive.

A representative formulation for improving the balance of durable press properties can include the following components (given in percent on weight of the finish bath of the as-received commercial product-note that the percentages provided herein are based on an as-received commercial product comprising approximately 40% modified DMUG reactant, e.g., 3.0% DMUG as recited herein represents approximately 1.2% active DMUG and, likewise, 40.0% DMUG as recited herein represents approximately 16% active DMUG): from about 3.0% to about 40.0% of non-formaldehyde dimethylurea/glyoxal (DMUG) and its analogs, including about 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, and 60% non-formaldehyde dimethylurea/glyoxal (DMUG), wherein the formulation is substantially free of dimethyloldihydroxyethyleneurea (DMDHEU); from about 0.1% to about 4.0% of dicyandiamide, choline chloride, ethyleneurea, propyleneurea, urea, dimethylurea, and combinations thereof, including from about 0.1, 0.2, 0.3, 0.4, 0.5, 0.6, 0.7, 0.8, 0.9, 1.0, 1.5, 2.0, 2.5, 3.0, 3.5, and 4.0% of dicyandiamide, choline chloride, ethyleneurea, propyleneurea, urea, dimethylurea, and combinations thereof; from about 0.5% to about 8.0% of a polyethylene softener (types may include medium density, high density, nonionic and/or cationic), including about 0.5, 0.6, 0.7, 0.8, 0.9, 1.0, 1.5, 2.0, 2.5, 3.0, 3.5, 4.0, 4.5, 5.0, 5.5, 6.0, 6.5, 7.0, 7.5, and 8.0% of a polyethylene softener (note that the percentages recited herein for a polyethylene softener are based on an as-received formulation comprising approximately 35% active polyethylene plus emulsifiers, e.g., 0.5% polyethylene softener represents approximately 0.175% active polyethylene and, likewise, 8.0% polyethylene softener represents approximately 2.8% active polyethylene); from about 0.0% to about 6.0% amino-functional silicone softener, including about 0.0, 0.1, 0.2, 0.3, 0.4, 0.5, 0.6, 0.7, 0.8, 0.9, 1.0, 1.5, 2.0, 2.5, 3.0, 3.5, 4.0, 4.5, 5.0, 5.5, and 6.0% amino-functional silicone softener (note that the percentages recited herein for an amino-functional silicone softener are based on an as-received formulation comprising approximately 25% active amino-functional silicone plus emulsifiers, e.g., 0.1% amino-functional silicone softener represents approximately 0.025% active amino-functional silicone and, likewise, 6.0% amino-functional silicone softener represents approximately 1.5% active amino-functional silicone); and from about 0.0 to about 10.0% of an acid catalyst, including from about 0.0 to about 10.0% of a Lewis acid catalyst (such as magnesium chloride, aluminum chloride, or magnesium sulfate) including from about 0.0, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, and 10% Lewis acid catalyst, or from about 0.0 to about 10.0% of a Brønsted acid catalyst (such as citric acid, acetic acid, or hydroxyacetic acid), including from about 0.0, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, and 10% Brønsted acid catalyst, or a blend of a Lewis acid catalyst and a Brønsted acid catalyst where the total acid catalyst is from 0.0 to about 10%. The amount of catalyst must be appropriate to adequately crosslink the DMUG resin and the additive used. For moist cure, a catalyst containing strong mineral acids, such as hydrochloric acid or sulfuric acid, is added at a concentration designated to achieve a pH that is normally in the range of 1.0 to 2.0. A small amount of a wetting agent also can be used to assist penetration of the finish. Other auxiliaries, including, but not limited to, fluorochemical repellents, hand builders, and the like, can be added to the above formulation if desired to provide additional performance properties. The specific amount of chemicals used in the finish formulation should be balanced with the wet pick-up of the fabric or substrate, which can range from about 30% to about 120%, including about 30, 35, 40, 45, 50, 55, 60, 65, 70, 75, 80, 85, 90, 95, 100, 105, 110, 115, and 120%, depending on the application method, but is typically from about 60% to about 100%, including about 60, 65, 70, 75, 80, 85, 90, 95, and 100%, for the conventional pad-dry-cure method. At low wet pick-ups (for example, foam finishing at about 30% wet pick-up), the abovementioned concentrations may have to be increased to achieve the same finish add-on.

As noted hereinabove, several components, e.g., DMUG, softeners, and the like, of the presently disclosed formulations are provided in aqueous solutions that are in diluted form and do not represent 100% active ingredients. Thus, the percentages listed for such components need to be adjusted accordingly. Components having a different percentage of active ingredient also are suitable for use with the presently disclosed formulations and methods. In such embodiments, one of ordinary skill in the art would appreciate that the concentration of the formulation can be adjusted to compensate for the difference in activity. Further, as used herein, the phrase "substantially free of dimethyloldihydroxyethyleneurea (DMDHEU)" means that the formulation comprises less than trace amounts of DMDHEU, which, in some embodiments, is less than about 0.1% or less of DMDHEU.

The presently disclosed formulations can be applied by a variety of application methods, including, but not limited to, pre-cure and post-cure conditions for fabrics, as well as garment treatments, such as garment-dip and metered addition, and the like. The substrate must be cured at an elevated temperature for an adequate amount of time to achieve sufficient cross-linking. Since commercial curing equipment can vary from one manufacturer to another, cure times and temperatures must be optimized for the specific equipment, application method, and substrate used. Cure temperatures can range from about 140° C. to 200° C., including about 140° C., 145° C., 150° C., 155° C., 160° C., 165° C., 170° C., 175° C., 180° C., 185° C., 190° C., 195° C., and 200° C., and cure times can range from about 10 seconds to about 10 minutes, including about 10 seconds, 30 seconds, 1 minute, 2 minutes, 3 minutes, 4 minutes, 5 minutes, 6 minutes, 7 minutes, 8 minutes, 9 minutes, and 10 minutes. To achieve the best improvement in durable press properties with the above formulation, it is recommended to use the lowest cure temperature that achieves sufficient crosslinking and is appropriate for the application method and substrate used. At higher cure temperatures, improvements in performance will still be observed with the optimized finish as compared to a standard durable press finish; however, the improvements may not be as significant as with samples cured at lower temperatures. In some embodiments, the drying can be performed simultaneously with the curing, e.g., so called "flash curing" and the total time in the oven would then be extended to include both drying and curing. Alternately, for the moist cure process, the fabric is then carefully dried to a residual moisture content, normally in the range of 6 percent to 12 percent. The fabric is then rolled onto an A-frame or similar device, which is then stored at a constant temperature of about 30-35° C. for 16 to 24 hours. The fabric is then neutralized and washed to remove the acidity, followed by drying.

The presently disclosed subject matter relates to cellulosic substrates and their blends, preferably cotton and cotton blends, and may include cellulosic fibers, yarns, fabrics, garments, and other articles having cellulosic fibers. The term "cellulosic substrate" as used herein refers to substrates that include cellulosic fibers, such as cotton, jute, flax, hemp, ramie, regenerated cellulose products (including, but not limited to, rayon (viscose), lyocell, and modal), blends thereof; and blends with other fibrous materials (such as, for example, synthetic fibers) in which, in some embodiments, at least about 25 percent, in other embodiments, at least about 40 percent, including about 25, 30, 35, and 40 percent, of the fibers are cellulosic materials. The cellulosic fibers preferably comprise cotton fibers. The cellulosic substrate may include non-cellulosic fibers (such as synthetic fibers and non-cellulosic natural fibers) including, for example, a polyolefin, such as polypropylene or polyethylene, polyester, nylon, polyvinyl, polyurethane, acetate, mineral fibers, silk, wool, polylactic acid (PLA), or polytrimethyl terephthalate (PTT), and mixtures thereof. In particular embodiments, the cellulosic substrate consists entirely of cellulosic fibers, such as cotton. The substrate may be any article that contains cellulosic fibers in the requisite amount, and includes, for example, woven fabrics, knit fabrics, nonwoven fabrics, multilayer fabrics, garments, yarns, and the like. More particularly, one embodiment of the presently disclosed finish includes the following chemicals (given in percent on weight of the finish bath of the as-received commercial product): about 10%-30.0% modified DMUG reactant (a suitable example is Arkofix NZF from Archroma), about 0.1%-4.0% of one of the additives listed above, depending on the particular additive, about 1%-5.0% polyethylene (high density, 35%) softener (a suitable example is Turpex ACN New from Huntsman Textile Effects), about 1.0%-5.0% amino-functional silicone (20%) softener (a suitable example is Marsil GSS from Marlin Chemical), and about 1.0%-4.0% activated magnesium chloride catalyst (a suitable example is Catalyst NKD from Archroma). In some embodiments, a small amount of a wetting agent (a suitable example is Fluowet UD from Archroma) can also be added to the formulation.

In particular embodiments, this representative durable press finish was applied as a pre-cure finish to 100% cotton 3/1 twill fabric (7.3 oz./yd$^2$), 100% cotton shirting 80/2 pinpoint oxford (3.9 oz./yd$^2$), and 100% cotton 24 cut interlock (5.8 oz./yd$^2$). The twill fabric was commercially prepared (desized, scoured, bleached, and mercerized) and was dyed into a vat khaki shade. For the twill fabric, the finish was pad applied at a wet pick-up of about 60% to about 65%, and the fabric was then dry/cured at about 160° C. for about 105 seconds in a continuous laboratory oven. The shirting fabric was commercially prepared (desized, scoured, and bleached) and was then treated by (A) mercerizing, followed by liquid ammonia pre-treatment, (B) mercerizing only, or (C) liquid ammonia pre-treatment only. The shirting fabric was then finished on a pilot scale tenter frame by pad applying finishes at 55-60% wet pick-up, followed by dry/curing at 160° C. for 75-90 seconds. The knit interlock fabric was prepared and reactive dyed into a medium blue shade in a sample jet machine. For the knit interlock, fabric samples were pre-marked to the dimensions of the pin frames, the finish was pad applied at a wet pick-up of about 115% to about 130%, the fabric was pinned on the frames along the marked edges, and the fabric was dry/cured at about 160° C. for about 90 seconds to about 120 seconds.

A variety of tests are used to access the performance of durable press finishes for cotton and other substrates. These tests include, but are not limited to, the following protocols and methods. Smoothness rating (AATCC TM124), is performed by laundering and drying fabric samples by a selected protocol, and then comparing the laundered samples to smoothness replicas. The smoothness replicas are on a scale of 1 to 5 with 1 being highly wrinkled and 5 having virtually no wrinkles. The laundering protocol used in the examples below used a top loading washing machine with a 4 pound load and a washing temperature of 40° C. with AATCC Standard Detergent (powder), and then the samples were tumble dried on "Cotton/Sturdy" setting. A total of 3 Home Laundering/Tumble Drying (HLTD) cycles were used for the examples below, but the laundering protocol can be altered to accommodate other types of washing machines and temperature settings. Durable press finishes such as the ones described in this invention tend to improve smoothness appearance ratings on cotton and other cellulosic fabrics. Another test is dimensional change (AATCC TM135), which measures the amount of shrinkage or growth of fabric samples (shrinkage is a negative value) after laundering and drying. The same laundering protocol was used for AATCC TM135 as was used for AATCC TM125. Durable press finishes tend to reduce shrinkage of cotton or other cellulosic fabrics. Tensile strength (ASTM D5034), and tear strength (ASTM D1424), were used to assess the amount of strength loss that can occur with durable press finishes. Crease Recovery Angle (AATCC TM66, modified to use an automated CRA tester), is sometimes used as a measure of durable press performance; this test is normally used as a research tool but not a performance standard. Higher crease recovery angles normally indicate improved durable press performance. Flex abrasion (ASTM D3885) and Martindale abrasion (ASTM D4966) are used to measure abrasion resistance; durable press finishes can cause abrasion losses on cotton fabrics. Crease retention (AATCC TM88C) is used to determine the durability of set-in creases for post-cured cotton or cellulosic garments (for example, pants or trousers with durable creases) after laundering. The same laundering protocol was used for crease retention in some examples below as was used for AATCC TM124. The crease retention test uses visual replicas similar to the ones used for smoothness appearance with AATCC TM124; this test is also on a 1 to 5 scale with 5 being the highest rating. Wrinkle recovery (AATCC TM128) is used to measure "dry wrinkle recovery" of fabrics (wrinkles that may occur during actual wear); this test is also a visual test using a 1 to 5 scale with 5 being the highest rating. Whiteness index is performed on a spectrophotometer and measure the amount of yellowing/darkening of the fabric; higher values are whiter or less yellow.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

EXAMPLES

The following Examples have been included to provide guidance to one of ordinary skill in the art for practicing representative embodiments of the presently disclosed subject matter. In light of the present disclosure and the general level of skill in the art, those of skill can appreciate that the following Examples are intended to be exemplary only and that numerous changes, modifications, and alterations can be employed without departing from the scope of the presently disclosed subject matter. The synthetic descriptions and specific examples that follow are only intended for the purposes of illustration, and are not to be construed as limiting in any manner to make compounds of the disclosure by other methods.

Example 1

Optimized finishes applied to 100% cotton twill in precure conditions are provided in the tables presented immediately herein below.

TABLE 1

Finish Formulas for Woven Twill Fabric, Set "35GW"

| grams per kg | 35GW-1 DMDHEU Control | 35GW-2 DMUG Formula | 35GW-3 DMUG + 1 Dicy | 35GW-4 DMUG + 2 Dicy | 35GW-5 DMUG + 3 Dicy | 35GW-6 DMUG + 4 Dicy | 35GW-7 Softener Only | 35GW-8 No Finish |
|---|---|---|---|---|---|---|---|---|
| Warm Water | 874 | 738 | 737 | 736 | 735 | 734 | 958 | — |
| Dicyandiamide | — | — | 1 | 2 | 3 | 4 | — | — |
| Wetting agent | 2 | 2 | 2 | 2 | 2 | 2 | 2 | — |
| Hi-conc DMDHEU reactant (~75% active) | 60 | — | — | — | — | — | — | — |

TABLE 1-continued

Finish Formulas for Woven Twill Fabric, Set "35GW"

| grams per kg | 35GW-1 DMDHEU Control | 35GW-2 DMUG Formula | 35GW-3 DMUG + 1 Dicy | 35GW-4 DMUG + 2 Dicy | 35GW-5 DMUG + 3 Dicy | 35GW-6 DMUG + 4 Dicy | 35GW-7 Softener Only | 35GW-8 No Finish |
|---|---|---|---|---|---|---|---|---|
| Catalyst for DMDHEU reactant ($MgCl_2$ blended with citric acid) | 24 | — | — | — | — | — | — | — |
| Modified DMUG reactant (~40% active) | — | 200 | 200 | 200 | 200 | 200 | — | — |
| Catalyst for DMUG reactant ($MgCl_2$ blended with an organic acid) | — | 20 | 20 | 20 | 20 | 20 | — | — |
| High density polyethylene | 10 | 10 | 10 | 10 | 10 | 10 | 10 | — |
| Amino silicone softener | 30 | 30 | 30 | 30 | 30 | 30 | 30 | — |
| Bath pH (meter) | | | | | | | | |
| Actual pH | 3.3 | 3.6 | 3.6 | 3.6 | 3.6 | 3.6 | 7.1 | N/A |
| % Wet pick-up | 61% | 61% | 62% | 61% | 61% | 60% | 62% | N/A |
| Cure Temperature, ° C. | 175 | 160 | 160 | 160 | 160 | 160 | 160 | N/A |
| Cure Time, seconds | 90 | 105 | 105 | 105 | 105 | 105 | 105 | |

Procedure:
Pad - 30 psi, 1 dip and 1 nip (target wet pick-up = 60-70%).
Dry/cure - at indicated time/temperature in continuous lab oven.

TABLE 2

Physical Test Results - Woven Twill Fabric, Set "35GW"

| Sample | | Smoothness | % Dimensional Change, 3 HLTD | | Tensile, lbs. | Tear, lbs. | CRA, ° | Flex abrasion Warp |
|---|---|---|---|---|---|---|---|---|
| ID | Description | 3 HLTD | Length | Width | Filling | Filling | W + F | (3 HLTD) |
| 35GW-1 | DMDHEU Control | 2.7 | −2.8 | −0.1 | 44 | 3.8 | 221 | 206 |
| 35GW-2 | DMUG | 2.8 | −3.0 | −0.2 | 59 | 5.7 | 222 | 3240 |
| 35GW-3 | DMUG + 1 Dicy | 2.8 | −3.3 | 0.0 | 57 | 5.4 | 219 | 3690 |
| 35GW-4 | DMUG + 2 Dicy | 2.9 | −3.4 | −0.3 | 60 | 5.9 | 191 | 4315 |
| 35GW-5 | DMUG + 3 Dicy | 2.9 | −3.2 | −0.1 | 57 | 5.7 | 222 | 4377 |
| 35GW-6 | DMUG + 4 Dicy | 2.7 | −3.3 | −0.3 | 60 | 5.9 | 223 | 4057 |
| 35GW-7 | Softener Only | 1.9 | −7.4 | −0.1 | 73 | 8.7 | 131 | 6604 |
| 35GW-8 | No Finish | 1.3 | −9.9 | 1.7 | 92 | 6.5 | 132 | 650 |

Key to abbreviations:
HLTD = Home Laundry/Tumble Drying cycles.
CRA = Crease Recovery Angle.

Referring to the finish formulas shown in Table 1 and the physical test results for the treated fabric samples in Table 2, the non-formaldehyde finish (Formula 35GW-2) provided similar smoothness to the DMDHEU Control (Formula 35GW-1); however, the tensile/tear strength and the flex abrasion were significantly higher for the non-formaldehyde finish. The progressive addition of dicyandiamide did not improve the tensile/tear strength of the non-formaldehyde finish, but it did improve the flex abrasion to some extent. The flex abrasion reached a maximum with 2 g/kg (0.2% on weight of bath) of dicyandiamide.

TABLE 3

Finish Formulas for Woven Twill Fabric, Set "49GW"

| grams per kg | 49GW-1 DMDHEU Control | 49GW-2 DMUG | 49GW-3 DMUG + 5 Dicy | 49GW-4 DMUG + 10 Dicy | 49GW-5 DMUG + 20 Dicy | 49GW-6 DMUG + 10 CC | 49GW-7 DMUG + 20 CC | 49GW-8 DMUG + 10 EU | 49GW-9 DMUG + 20 EU | 49GW-10 No Finish |
|---|---|---|---|---|---|---|---|---|---|---|
| Warm Water | 874 | 738 | 688 | 638 | 538 | 718 | 698 | 713 | 688 | — |
| Dicyandiamide (10%) | — | — | 50 | 100 | 200 | — | — | — | — | — |
| Choline Chloride (50%) | — | — | — | — | — | 20 | 40 | — | — | — |
| Ethyleneurea (40%) | | | | | | | | 25 | 50 | — |
| Wetting agent | 2 | 2 | 2 | 2 | 2 | 2 | 2 | 2 | 2 | — |
| Hi-conc DMDHEU reactant (~75% active) | 60 | — | — | — | — | — | — | — | — | — |
| Catalyst for DMDHEU reactant ($MgCl_2$ blended with citric acid) | 24 | — | — | — | — | — | — | — | — | — |

TABLE 3-continued

Finish Formulas for Woven Twill Fabric, Set "49GW"

| grams per kg | 49GW-1 DMDHEU Control | 49GW-2 DMUG | 49GW-3 DMUG + 5 Dicy | 49GW-4 DMUG + 10 Dicy | 49GW-5 DMUG + 20 Dicy | 49GW-6 DMUG + 10 CC | 49GW-7 DMUG + 20 CC | 49GW-8 DMUG + 10 EU | 49GW-9 DMUG + 20 EU | 49GW-10 No Finish |
|---|---|---|---|---|---|---|---|---|---|---|
| Modified DMUG reactant (~40% active) | — | 200 | 200 | 200 | 200 | 200 | 200 | 200 | 200 | — |
| Catalyst for DMUG reactant ($MgCl_2$ blended with an organic acid) | — | 20 | 20 | 20 | 20 | 20 | 20 | 20 | 20 | — |
| High density polyethylene | 10 | 10 | 10 | 10 | 10 | 10 | 10 | 10 | 10 | — |
| Amino silicone softener | 30 | 30 | 30 | 30 | 30 | 30 | 30 | 30 | 30 | — |
| Bath pH (meter) | | | | | | | | | | |
| Actual pH | 3.5 | 3.7 | 3.7 | 3.7 | 3.7 | 3.6 | 3.6 | 4.0 | 4.2 | N/A |
| % Wet pick-up | 63% | 62% | 62% | 60% | 62% | 63% | 63% | 62% | 62% | N/A |
| Cure Temperature, ° C. | 175 | 160 | 160 | 160 | 160 | 160 | 160 | 160 | 160 | N/A |
| Cure Time, seconds | 90 | 105 | 105 | 105 | 105 | 105 | 105 | 105 | 105 | |

Procedure:
Pad - 30 psi, 1 dip and 1 nip (target wet pick-up = 60-70%).
Dry/cure - at indicated time/temperature in continuous lab oven.

TABLE 4

Physical Test Results - Woven Twill Fabric, Set "49GW"

| Sample | | Smoothness | % Dimensional Change, 3 HLTD | | Tensile, lbs. | Tear, lbs. | CRA, ° | Flex abrasion Warp |
|---|---|---|---|---|---|---|---|---|
| ID | Description | 3 HLTD | Length | Width | Filling | Filling | W + F | (3 HLTD) |
| 49GW-1 | DMDHEU Control | 2.7 | −3.3 | 0.2 | 47.4 | 3.9 | 187 | 272 |
| 49GW-2 | DMUG | 2.8 | −3.0 | 0.1 | 59.3 | 5.3 | 200 | 4023 |
| 49GW-3 | DMUG + 5 Dicy | 2.7 | −4.2 | 0.1 | 63.4 | 6.6 | 193 | 6440 |
| 49GW-4 | DMUG + 10 Dicy | 2.2 | −4.4 | 0.0 | 62.8 | 6.5 | 195 | 6321 |
| 49GW-5 | DMUG + 20 Dicy | 2.9 | −5.1 | −0.2 | 63.6 | 6.6 | 183 | 6838 |
| 49GW-6 | DMUG + 10 CC | 3.0 | −3.5 | −0.2 | 57.9 | 5.8 | 197 | 4256 |
| 49GW-7 | DMUG + 20 CC | 3.0 | −3.5 | 0.0 | 59.1 | 5.7 | 193 | 4054 |
| 49GW-8 | DMUG + 10 EU | 2.9 | −3.5 | 0.0 | 59.5 | 5.9 | 199 | 5422 |
| 49GW-9 | DMUG + 20 EU | 2.4 | −4.2 | 0.1 | 61.7 | 6.5 | 192 | 7460 |
| 49GW-10 | No Finish | 1.0 | −11.3 | 1.5 | 94.9 | 6.3 | 135 | 686 |

Key to abbreviations:
HLTD = Home Laundry/Tumble Drying cycles.
CRA = Crease Recovery Angle.
CC = Choline Chloride.
EU = Ethyleneurea.

Referring to the finish formulas shown in Table 3 and the physical test results for the treated fabric samples in Table 4, higher amounts of dicyandiamide were added to the non-formaldehyde recipe. The smoothness results were unexpected; the smoothness rating dropped at 10 g/kg dicyandiamide, but it did not drop at 20 g/kg. The CRA data also was in conflict with the smoothness ratings with the dicyandiamide and the shrinkage progressively increased with more dicyandiamide. It is suspected the increased shrinkage occurred when the dicyandiamide concentration was too high and began to interfere with crosslinking. The tensile, tear, and flex abrasion increased with the addition of dicyandiamide; these data appeared to reach a maximum at 5 g/kg (0.5% on weight of bath) of dicyandiamide.

The options of adding choline chloride or ethyleneurea also were explored in the 49GW Series. Again referring to Table 4, choline chloride appeared to have a slight impact on smoothness and tear strength in comparison with DMUG only (49GW-2). Ethyleneurea yielded some improvement on tear strength and flex abrasion, but at 20 g/kg the smoothness rating dropped. The optimum amount of ethyleneurea appears to be between about 10 and about 20 g/kg ethyleneurea.

TABLE 5

Finish Formulas for Woven Twill Fabric, Set "FC10"

| grams per kg | FC10-1 DMDHEU Control | FC10-2 DMUG A | FC10-3 DMUG A + 2 g/L Dicy | FC10-4 DMUG A + 3 g/L Dicy | FC10-5 DMUG B | FC10-6 DMUG B + 2 g/L Dicy | FC10-7 DMUG B + 3 g/L Dicy | FC10-8 No Finish |
|---|---|---|---|---|---|---|---|---|
| Warm water | 874 | 738 | 736 | 735 | 728 | 726 | 725 | |
| Dicyandiamide | — | — | 2 | 3 | — | 2 | 3 | |
| Wetting agent | 2 | 2 | 2 | 2 | 2 | 2 | 2 | |

TABLE 5-continued

| Finish Formulas for Woven Twill Fabric, Set "FC10" | | | | | | | | |
|---|---|---|---|---|---|---|---|---|
| grams per kg | FC10-1 DMDHEU Control | FC10-2 DMUG A | FC10-3 DMUG A + 2 g/L Dicy | FC10-4 DMUG A + 3 g/L Dicy | FC10-5 DMUG B | FC10-6 DMUG B + 2 g/L Dicy | FC10-7 DMUG B + 3 g/L Dicy | FC10-8 No Finish |
| Hi-conc DMDHEU reactant (~75% active) | 60 | — | — | — | — | — | — | |
| High density polyethylene | 10 | 10 | 10 | 10 | 10 | 10 | 10 | |
| Amino silicone softener | 30 | 30 | 30 | 30 | 30 | 30 | 30 | |
| Catalyst for DMDHEU reactant ($MgCl_2$ blended with citric acid) | 24 | — | — | — | — | — | — | |
| Modified DMUG reactant A (~40% active) | — | 200 | 200 | 200 | — | — | — | |
| Modified DMUG reactant B (~40% active) | — | — | — | — | 200 | 200 | 200 | |
| Catalyst A for DMUG reactant A ($MgCl_2$ blended with an organic acid) | — | 20 | 20 | 20 | — | — | — | |
| Catalyst B for DMUG reactant B ($MgCl_2$ blended with an organic acid) | — | — | — | — | 30 | 30 | 30 | |
| Bath pH (meter) | 3.39 | 3.47 | 3.51 | 3.55 | 3.53 | 3.46 | 3.46 | |
| % Wet pick-up | 64% | 65% | 65% | 64% | 64% | 63% | 62% | |
| Cure Temperature, ° C. | 177 | 160 | 160 | 160 | 160 | 160 | 160 | |
| Cure Time, seconds | 90 | 105 | 105 | 105 | 105 | 105 | 105 | |

Procedure:

Pad - 30 psi, 1 dip and 1 nip (target wet pick-up = 60-70%).

Dry/cure - at indicated time/temperature in continuous lab oven.

TABLE 6

| Physical Test Results - Woven Twill Fabric, Set "FC10" | | | | | | | | |
|---|---|---|---|---|---|---|---|---|
| | | Smoothness | % Dimensional Change, 3 HLTD | | Tensile, lbs. | Tear, lbs. | CRA, ° W + F | Flex cycles Warp |
| Sample ID | Description | 3 HLTD | Length | Width | Filling | Filling | 3 HLTD | 3 HLTD |
| FC10-1 | DMDHEU Control Finish | 2.9 | −3.2 | 0.0 | 51.6 | 4.6 | 189 | 190 |
| FC10-2 | DMUG A | 3.1 | −3.0 | 0.0 | 63.0 | 6.0 | 202 | 1615 |
| FC10-3 | DMUG A + 2 g/L Dicy | 3.0 | −3.3 | 0.0 | 65.7 | 6.0 | 198 | 1689 |
| FC10-4 | DMUG A + 3 g/L Dicy | 3.3 | −3.3 | −0.1 | 65.4 | 6.2 | 189 | 2442 |
| FC10-5 | DMUG B | 3.2 | −3.5 | −0.1 | 64.2 | 5.8 | 191 | 2605 |
| FC10-6 | DMUG B + 2 g/L Dicy | 2.7 | −2.8 | 0.5 | 66.5 | 6.0 | 183 | 2400 |
| FC10-7 | DMUG B + 3 g/L Dicy | 2.9 | −4.0 | −0.1 | 68.6 | 6.2 | 180 | 3220 |
| FC10-8 | No Finish | 1.0 | −10.0 | 1.4 | 102.3 | 6.2 | 117 | 573 |

Key to abbreviations:

HLTD = Home Laundry/Tumble Drying cycles.

CRA = Crease Recovery Angle.

Referring to the finish formulas shown in Table 5 and the physical test results for the treated fabric samples in Table 6, two different DMUG systems were compared in pre-cure finishes with and without dicyandiamide as an additive. DMUG A and Catalyst A were the aforementioned Arkofix NZF and Catalyst NKD from Archroma. DMUG B and Catalyst B were Reacel ZF and Catal MCA from Bozzetto, Inc. Both DMUG systems yielded slightly higher smoothness ratings than the DMDHEU Control Finish. When dicyandiamide was added to each DMUG system, there were small fluctuations in smoothness ratings, but no changes of significance were noted. (The only possible exception was a drop in smoothness with DMUG B when 2 g/L dicyandiamide was added (2.7 vs. 3.2), but with 3 g/L dicyandiamide the smoothness was somewhat higher (2.9) so there appears to be no trend. Tensile, tear, and flex abrasion data with all DMUG finishes were significantly higher than the DMDHEU Control, and increasing concentrations of dicyandiamide yielded small but incremental improvements for these properties with both DMUG systems.

TABLE 7

Finish Formulas for Woven Twill Fabric, Set "FC11"

| grams per kg | FC11-1 DMUG No Dicy 160 C./ 45 s | FC11-2 DMUG No Dicy 160 C./ 60 s | FC11-3 DMUG No Dicy 170 C./ 45 s | FC11-4 DMUG No Dicy 170 C./ 60 s | FC11-5 DMUG with Dicy 160 C./ 45 s | FC11-6 DMUG with Dicy 160 C./ 60 s | FC11-7 DMUG with Dicy 170 C./ 45 s | FC11-8 DMUG with Dicy 170 C./ 60 s | FC11-9 No Finish |
|---|---|---|---|---|---|---|---|---|---|
| Warm water | 738 | 738 | 738 | 738 | 735 | 735 | 735 | 735 | — |
| Dicyandiamide | — | — | | | 3 | 3 | 3 | 3 | — |
| Wetting agent | 2 | 2 | 2 | 2 | 2 | 2 | 2 | 2 | — |
| High density polyethylene | 10 | 10 | 10 | 10 | 10 | 10 | 10 | 10 | — |
| Amino silicone softener | 30 | 30 | 30 | 30 | 30 | 30 | 30 | 30 | — |
| Modified DMUG reactant (~40% active) | 200 | 200 | 200 | 200 | 200 | 200 | 200 | 200 | |
| Catalyst for DMUG reactant ($MgCl_2$ blended with an organic acid) | 20 | 20 | 20 | 20 | 20 | 20 | 20 | 20 | |
| Bath pH (meter) | 3.57 | 3.57 | 3.57 | 3.57 | 3.52 | 3.52 | 3.52 | 3.52 | N/A |
| % Wet pick-up | 62% | 62% | 62% | 62% | 62% | 62% | 62% | 62% | N/A |
| Cure Temperature, ° C. | 160 | 160 | 170 | 170 | 160 | 160 | 170 | 170 | |
| Cure Time, seconds | 45 | 60 | 45 | 60 | 45 | 60 | 45 | 60 | |

Procedure:
Pad - 30 psi, 1 dip and 1 nip (target wet pick-up = 60-70%).
Dry - 110° C. for 75 seconds in continuous lab oven.
Light press for 4 seconds (to simulate stretching in a tenter frame.
Cure at times/temperatures shown in Table 7 in continuous lab oven.

TABLE 8

Physical Test Results - Woven Twill Fabric, Set "FC11"

| Sample ID | Description | Smoothness 3 HLTD | % Dimensional Change, 3 HLTD Length | % Dimensional Change, 3 HLTD Width | Tensile, lbs. Filling | Tear, lbs. Filling | CRA, w + f 3 HLTD Degrees | Flex cycles 3 HLTD Warp |
|---|---|---|---|---|---|---|---|---|
| FC11-1 | No Dicy-160 C./45 S | 3.2 | −1.3 | −0.2 | 62.9 | 5.8 | 203 | 2157 |
| FC11-2 | No Dicy-160 C./60 S | 3.0 | −2.6 | −0.3 | 57.4 | 6.0 | 206 | 2166 |
| FC11-3 | No Dicy-170 C./45 S | 3.1 | −2.5 | −0.4 | 62.8 | 6.1 | 200 | 1938 |
| FC11-4 | No Dicy-170 C./60 S | 3.1 | −2.6 | −0.4 | 58.1 | 5.7 | 208 | 1935 |
| FC11-5 | Dicy-160 C./45 S | 2.8 | −3.1 | −0.2 | 67.2 | 6.3 | 189 | 2976 |
| FC11-6 | Dicy-160 C./60 S | 3.0 | −2.8 | −0.4 | 66.7 | 5.9 | 189 | 3146 |
| FC11-7 | Dicy-170 C./45 S | 2.9 | −2.6 | −0.1 | 65.1 | 6.0 | 205 | 2788 |
| FC11-8 | Dicy-170 C./60 S | 3.3 | −2.6 | −0.2 | 59.4 | 5.9 | 220 | 2278 |
| FC11-9 | No Finish | 1.0 | −9.5 | 1.5 | 101.0 | 5.7 | 123 | 568 |

Key to abbreviations:
HLTD = Home Laundry/Tumble Drying cycles.
CRA = Crease Recovery Angle.

Referring to the finish formulas shown in Table 7 and the physical test results for the treated fabric samples in Table 8, a DMUG finish was applied to cotton twill fabric in formulas with and without dicyandiamide. The treated fabric samples were dried, and then cured at temperatures of either 160 or 170° C. using times of either 45 or 60 seconds. The formulas without dicyandiamide all had similar smoothness ratings at all curing conditions. The smoothness ratings for the formulas with dicyandiamide appeared to have a slight trend toward increasing smoothness with higher curing temperatures/longer curing times. Tensile strength was generally higher with dicyandiamide added to the finish, except at 170° C./60 seconds cure the tensile dropped to nearly the same value as the one without dicyandiamide cured at 170° C./60 seconds. Tear strength was not generally affected by the addition of dicyandiamide in this experiment. Flex abrasion was generally improved at all curing conditions with the addition of dicyandiamide, except at 170° C./60 seconds the improvement in flex diminished as it did for tensile strength.

TABLE 9

Finish Formulas for Woven Twill Fabric, Set "FC12"

| grams per kg | FC12-1 DMUG Only | FC12-2 DMUG 5 Urea | FC12-3 DMUG 10 Urea | FC12-4 DMUG 5 EU | FC12-5 DMUG 10 EU | FC12-6 DMUG 5 Crea | FC12-7 DMUG 10 Crea | FC12-8 DMUG 5 TMU | FC12-9 DMUG 10 TMU | FC12-10 DMUG 10 Gua | FC12-11 DMUG 20 Gua | FC12-12 No Finish |
|---|---|---|---|---|---|---|---|---|---|---|---|---|
| Water | 738 | 728 | 718 | 703.1 | 643.8 | 702.2 | 656 | 733 | 728 | 728 | 718 | — |
| Urea (50% w/w solution) | — | 10 | 20 | — | — | — | — | — | — | — | — | — |

TABLE 9-continued

Finish Formulas for Woven Twill Fabric, Set "FC12"

| grams per kg | FC12-1 DMUG Only | FC12-2 DMUG 5 Urea | FC12-3 DMUG 10 Urea | FC12-4 DMUG 5 EU | FC12-5 DMUG 10 EU | FC12-6 DMUG 5 Crea | FC12-7 DMUG 10 Crea | FC12-8 DMUG 5 TMU | FC12-9 DMUG 10 TMU | FC12-10 DMUG 10 Gua | FC12-11 DMUG 20 Gua | FC12-12 No Finish |
|---|---|---|---|---|---|---|---|---|---|---|---|---|
| Ethyleneurea (40% w/w solution) | — | — | — | 12.5 | 25 | — | — | — | — | — | — | — |
| Creatine monohydrate* | — | — | — | — | — | 5 | 10 | — | — | — | — | — |
| Trimethylurea (100%) | — | — | — | — | — | — | — | 5 | 10 | — | — | — |
| Guanidine hydrochloride (50% w/w solution) | — | — | — | — | — | — | — | — | — | 10 | 20 | — |
| Wetting agent | 2 | 2 | 2 | 2 | 2 | 2 | 2 | 2 | 2 | 2 | 2 | — |
| Modified DMUG reactant (~40% active) | 200 | 200 | 200 | 200 | 200 | 200 | 200 | 200 | 200 | 200 | 200 | — |
| Catalyst for DMUG reactant ($MgCl_2$ blended with an organic acid) | 20 | 20 | 20 | 20 | 20 | 20 | 20 | 20 | 20 | 20 | 20 | — |
| High density polyethylene | 10 | 10 | 10 | 10 | 10 | 10 | 10 | 10 | 10 | 10 | 10 | — |
| Amino silicone softener | 30 | 30 | 30 | 30 | 30 | 30 | 30 | 30 | 30 | 30 | 30 | — |
| Hydrochloric acid (0.1N) | — | — | — | 22.4 | 69.2 | 30.8 | 72 | 0 | 0 | 0 | 0 | — |
| Bath pH (meter) | | | | | | | | | | | | |
| Target pH | 3.6 | 3.6 | 3.6 | 3.6 | 3.6 | 3.6 | 3.6 | 3.6 | 3.6 | 3.6 | 3.6 | |
| Actual pH | 3.62 | 3.47 | 3.51 | 3.56 | 3.62 | 3.61 | 3.60 | 3.52 | 3.60 | 3.54 | 3.52 | |
| % Wet pick-up | 61% | 60% | 62% | 61% | 60% | 61% | 60% | 62% | 62% | 62% | 62% | N/A |

Procedure: Pad-30 psi, 1 dip and 1 nip (target wet pick-up = 60-70%). Dry/cure-at 160° C. for 105 seconds continuous lab oven.

TABLE 10

Physical Test Results-Woven Twill Fabric, Set "FC12"

| Sample | | Smoothness | % Dimensional Change, 3 HLTD | | Tensile, lbs. | Tear, lbs. | CRA, w + f 3 HLTD | Flex cycles 3 HLTD |
|---|---|---|---|---|---|---|---|---|
| ID | Description | 3 HLTD | Length | Width | Filling | Filling | Degrees | Warp |
| FC12-1 | 200 DMUG Only | 2.7 | −3.2 | −0.1 | 60.5 | 5.8 | 219 | 2018 |
| FC12-2 | DMUG + 5 Urea | 2.5 | −3.5 | −0.2 | 62.0 | 6.1 | 210 | 2426 |
| FC12-3 | DMUG + 10 Urea | 2.9 | −4.0 | −0.2 | 63.8 | 6.4 | 192 | 3221 |
| FC12-4 | DMUG + 5 EU | 2.6 | −3.5 | −0.1 | 61.6 | 6.0 | 195 | 2812 |
| FC12-5 | DMUG + 10 EU | 2.7 | −3.6 | −0.1 | 61.9 | 5.9 | 196 | 2897 |
| FC12-6 | DMUG + 5 Crea | 2.9 | −3.3 | −0.1 | 62.2 | 5.8 | 205 | 1611 |
| FC12-7 | DMUG + 10 Crea | 2.4 | −3.4 | −0.1 | 62.6 | 5.9 | 208 | 2783 |
| FC12-8 | DMUG + 5 TMU | 2.7 | −3.3 | −0.2 | 60.4 | 5.8 | 220 | 2040 |
| FC12-9 | DMUG + 10 TMU | 2.8 | −3.2 | 0.1 | 58.1 | 5.7 | 220 | 2395 |
| FC12-10 | DMUG + 10 Gua | 3.1 | −3.6 | 0.2 | 60.4 | 5.8 | 224 | 1678 |
| FC12-11 | DMUG + 20 Gua | 2.8 | −3.7 | 0.1 | 60.9 | 5.8 | 217 | 1856 |
| FC12-12 | No Finish | 1.0 | −10.6 | 1.6 | 98.3 | 6.6 | 132 | 499 |

Key to abbreviations:
HLTD = Home Laundry/Tumble Drying cycles.
CRA = Crease Recovery Angle.

Referring to the finish formulas shown in Table 9 and the physical test results for the treated fabric samples in Table 10, several additives (other than dicyandiamide) were tested in a finish containing DMUG on cotton twill fabric. This is a follow-up experiment to the one shown in Tables 3 and 4. Note that some additives had an effect on finish bath pH; in those cases, dilute hydrochloric acid was carefully added to lower the finish bath pH to 3.5 (this is close to the pH of the DMUG-only bath). The results for each additive will be discussed individually:

Urea: Although the smoothness rating appeared to drop with the addition of g/L urea as compared to the DMUG-only finish, smoothness was actually slightly higher with 10 g/L urea. Tensile, tear, and flex abrasion values were higher with increasing amounts of urea added to the finish.

Ethyleneurea (EU): Smoothness ratings were not impacted by the addition of ethylene urea to the finish. The addition of ethyleneurea resulted in only slight gains in tensile and tear strength; however, flex abrasion was significantly improved with ethyleneurea.

Creatine (Crea): Smoothness was not impacted with 5 g/L creatine, but at 10 g/L creatine the smoothness rating decreased. The addition of creatine resulted in only slight gains in tensile and tear strength as compared with DMUG-only. With 5 g/L creatine, flex abrasion was actually lower; flex abrasion increased with 10 g/L creatine.

Trimethylurea (TMU): Trimethylurea had little impact on any properties at either concentration.

Guanidine (Gua): Guanidine had little impact on any properties at either concentration.

To summarize the experiment with the additives as shown in Tables 9 and 10, urea and ethyleneurea had positive impacts on abrasion and strength retention without negative impacts on smoothness ratings. The other additives either did not improve properties or had negative impacts on smoothness retention.

TABLE 11

Post-cure Formulas for Woven Twill Fabric, Set "53GW"

| grams per kg | 53GW-1 DMDHEU Control | 53GW-2 DMUG A | 53GW-3 DMUG A + 2 Dicy | 53GW-5 DMUG B | 53GW-6 DMUG A + 2 Dicy | 53GW-8 No Finish |
|---|---|---|---|---|---|---|
| Warm Water | 832 | 683 | 683 | 670.5 | 670.5 | |
| Dicyandiamide | — | — | 2 | — | 2 | |
| Wetting agent | 2 | 2 | 2 | 2 | 2 | |
| Hi-conc DMDHEU reactant (~75% active) | 90 | — | — | — | — | |
| Catalyst for DMDHEU ($MgCl_2$) | 36 | — | — | — | — | |
| Modified DMUG reactant A (~40% active) | — | 250 | 250 | — | — | |
| Catalyst A for DMUG reactant A ($MgCl_2$ blended with an organic acid) | — | 25 | 25 | — | — | |
| Modified DMUG reactant B (~40% active) | — | — | — | 250 | 250 | |
| Catalyst B for DMUG reactant B ($MgCl_2$ blended with an organic acid) | — | — | — | 37.5 | 37.5 | |
| High density polyethylene | 30 | 30 | 30 | 30 | 30 | |
| Amino silicone softener | 10 | 10 | 10 | 10 | 10 | |
| Bath pH (meter) | 4.1 | 3.6 | 3.6 | 3.3 | 3.3 | |
| % Wet pick-up | 61% | 61% | 61% | 60% | 61% | |

Post-cure procedure: Pad at 30 psi, 1 dip & 1 nip (target wet pick-up = 60-70%). Dry at 60 seconds dwell time at 95° C. in continuous lab oven. For post curing, cut and sew simulated pant legs for crease appearance testing; use flat panels for other tests. Use a flat steam press to press pant legs or flat panels. Cure samples in a large batch oven at 150° C. for 10 minutes.

TABLE 12

Physical Test Results-Woven Twill Fabric, Set "53GW"

| Sample | | Smoothness | % Dimensional Change, 3 HLTD | | Crease Retention, | Tensile, lbs. | Tear, lbs. | CRA, ° W + F |
|---|---|---|---|---|---|---|---|---|
| ID | Description | 3 HLTD | Length | Width | 3 HLTD | Filling | Filling | 3 HLTD |
| 53GW-1 | DMDHEU Control | 3.2 | −2.4 | 0.4 | 4.8 | 47 | 4.0 | 204 |
| 53GW-2 | DMUG A | 3.1 | −2.8 | 0.3 | 2.5 | 55 | 5.3 | 204 |
| 53GW-3 | DMUG A + 2 Dicy | 3.1 | −3.1 | 0.1 | 4.8 | 59 | 5.5 | 211 |
| 53GW-5 | DMUG B | 2.8 | −3.5 | 0.2 | 3.7 | 59 | 5.4 | 197 |
| 53GW-6 | DMUG B + 2 Dicy | 3.2 | −3.3 | 0.2 | 2.0 | 60 | 5.8 | 196 |
| 53GW-8 | No Finish | 1.1 | −10.7 | 1.5 | 1.0 | 98 | 6.0 | 122 |

Key to abbreviations:

HLTD = Home Laundry/Tumble Drying cycles.

CRA = Crease Recovery Angle.

Referring to the finish formulas in Table 11 and the physical test results for the treated fabric samples in Table 12, two different DMUG systems were compared in post-cure finishes with and without dicyandiamide as an additive. DMUG A and Catalyst A were the aforementioned Arkofix NZF and Catalyst NKD from Archroma. DMUG B and Catalyst B were Reacel ZF and Catal MCA from Bozzetto, Inc. The two DMUG systems provided similar smoothness appearance ratings to one another as well as to the DMDHEU Control, and the addition of dicyandiamide did not impair the smoothness ratings. Crease retention rating were somewhat inconsistent; it was later found the steam press had some problems with the steam injection valve. The two non-formaldehyde systems had higher tensile and tear values than the DMDHEU Control. The addition of dicyandiamide resulted in small tensile and tear gains with both DMUG systems.

TABLE 13

Finish Formulas for 100% Cotton Shirting (80/2 Pinpoint Oxford)

| grams per kg | 68KGB-1 DMDHEU Control | 68KGB-2 200 g/L DMUG | 68KGB-3 200 g/L DMUG + Dicy | 68KGB-4 300 g/L DMUG | 68KGB-5 300 g/L DMUG + Dicy | 68KGB-6 No Finish |
|---|---|---|---|---|---|---|
| Water | 868 | 738 | 733 | 628 | 623 | No Finish |
| Dicyandiamide | — | — | 5 | — | 5 | |
| Wetting agent | 2 | 2 | 2 | 2 | 2 | |
| Hi-conc DMDHEU reactant (~75% active) | 60 | — | — | — | — | |
| Modified DMUG reactant (~40% active) | — | 200 | 200 | 300 | 300 | |
| Catalyst for DMDHEU reactant ($MgCl_2$ blended with citric acid) | 30 | — | — | — | — | |
| Catalyst for DMUG reactant ($MgCl_2$ blended with an organic acid) | — | 20 | 20 | 30 | 30 | |
| High density polyethylene | 10 | 10 | 10 | 10 | 10 | |
| Amino silicone softener | 30 | 30 | 30 | 30 | 30 | |
| Bath pH (meter) | 4.19 | 3.48 | 3.51 | 3.38 | 3.25 | N/A |
| Dry/Cure Temperature, ° C. | 171 | 160 | 160 | 160 | 160 | |
| Dry/Cure Time, seconds | 90 | 75 | 75 | 75 | 75 | |
| Tenter speed, m/min | 6.5 | 7.8 | 7.8 | 7.8 | 7.8 | |

Procedure: Trials were conducted on a pilot scale tenter frame. Padding was performed at 65 psi (wet pick-up was 55-60% wet pick-up). The fabrics were dry/cured at the times and temperatures shown in Table 13.

TABLE 14A

Physical Test Results-100% Cotton Shirting (80/2 Pinpoint Oxford)
(Fabric A-Mercerized/Liquid Ammonia Pre-Treated)

| Sample ID Description | | 68KGB-1 DMDHEU Control | 68KGB-2 200 g/L DMUG | 68KGB-3 200 g/L DMUG + Dicy | 68KGB-4 300 g/L DMUG | 68KGB-5 300 g/L DMUG + Dicy | 68KGB-6 No Finish |
|---|---|---|---|---|---|---|---|
| Smoothness Appearance | 3 HLTD | 2.1 | 2.6 | 2.6 | 3.1 | 2.5 | 1.7 |
| % Dimensional Change 3 HLTD | Warp | −2.1 | −2.4 | −2.7 | −2.1 | −2.4 | −5.3 |
| | Filling | −1.8 | −1.8 | −2.0 | −1.5 | −1.7 | −0.5 |
| Tensile, lbs. | Warp | 95.1 | 108.1 | 108.0 | 98.0 | 105.6 | 146.7 |
| | Filling | 34.5 | 34.8 | 39.5 | 36.2 | 38.6 | 54.7 |
| Tear, lbs. | Warp | DNT | DNT | DNT | DNT | DNT | DNT |
| | Filling | 3.7 | 4.7 | 5.7 | 4.1 | 4.8 | 2.0 |
| Warp Flex Abrasion | 3 HLTD | 769 | 1318 | 1537 | 1142 | 1650 | 494 |
| Whiteness Index | CIE | 88 | 84 | 90 | 85 | 88 | 83 |
| Wrinkle Recovery | AATCC 128 | 2.0 | 2.0 | 2.0 | 1.9 | 1.9 | 1.7 |
| Formaldehyde μg/g | AATCC 112 | 100 | 4 | 2 | 2 | 0 | 2 |
| | ISO 14184-1 | 75 | 4 | 4 | 3 | 4 | 1 |
| CRA, ° (w + f) | 3 HLTD | 185 | 199 | 188 | 246 | 241 | 171 |

TABLE 14A-continued

| Physical Test Results-100% Cotton Shirting (80/2 Pinpoint Oxford) (Fabric A-Mercerized/Liquid Ammonia Pre-Treated) | | | | | | | |
|---|---|---|---|---|---|---|---|
| Sample ID Description | | 68KGB-1 DMDHEU Control | 68KGB-2 200 g/L DMUG | 68KGB-3 200 g/L DMUG + Dicy | 68KGB-4 300 g/L DMUG | 68KGB-5 300 g/L DMUG + Dicy | 68KGB-6 No Finish |
| % Nitrogen | Original | 0.27 | 0.61 | 0.88 | 0.89 | 1.13 | 0.03 |
| | Washed | 0.20 | 0.39 | 0.42 | 0.58 | 0.62 | N/A |
| | % Fixation | 70.3 | 62.1 | 46.2 | 63.3 | 53.1 | N/A |

Key to abbreviations:
HLTD = Home Laundry/Tumble Drying cycles.
CRA = Crease Recovery Angle.
DNT = Did Not Tear (samples tore in the traverse direction).

Referring to the finish formulas shown in Table 13 and the physical test results for the treated fabric samples in Table 14A (mercerized/liquid ammonia pre-treated fabric), the smoothness ratings for all non-formaldehyde trials using the DMUG reactant were higher than the DMDHEU Control. The addition of dicyandiamide to the finish with 200 g/L DMUG did not change the smoothness rating; however, there was a decrease in smoothness with the finish containing 300 g/L DMUG when dicyandiamide was added. Tensile and tear strength were generally higher for the DMUG finishes than the DMDHEU Control. The addition of dicyandiamide resulted in increases in tensile and tear strength in the finishes with both concentrations of DMUG (200 and 300 g/L). Flex abrasion was higher with all DMUG finishes than the DMDHEU Control, and the addition of dicyandiamide resulted in further improvements in flex abrasion. Formaldehyde levels for all DMUG finishes, with and without dicyandiamide, were below detectability in both AATCC Test Method 112 and ISO 14184-1. Whiteness indices for all non-formaldehyde finishes were all acceptable.

Referring to the finish formulas shown in Table 13 and the physical test results for the treated fabric samples in Table 14B (mercerized only fabric), the smoothness ratings for all non-formaldehyde trials using the DMUG reactant were higher than the DMDHEU Control. The addition of dicyandiamide resulted in slight decreases in smoothness ratings with both concentrations of DMUG (200 and 300 g/L). Tensile and tear strength were generally higher for the DMUG finishes than the DMDHEU Control. The addition of dicyandiamide resulted in increases in tensile and tear strength in the finishes with both concentrations of DMUG. Flex abrasion was higher with all DMUG finishes than the DMDHEU Control, and the addition of dicyandiamide resulted in further improvements in flex abrasion. Note that the wrinkle recovery test is a very severe test for woven cotton fabrics, so all results were low (2.0 or less.) Whiteness indices for all non-formaldehyde finishes were all acceptable.

TABLE 14B

| Physical Test Results-100% Cotton Shirting (80/2 Pinpoint Oxford) (Fabric B-Mercerized Only) | | | | | | | |
|---|---|---|---|---|---|---|---|
| Sample ID Description | | 68KGB-1 DMDHEU Control | 68KGB-2 200 g/L DMUG | 68KGB-3 200 g/L DMUG + Dicy | 68KGB-4 300 g/L DMUG | 68KGB-5 300 g/L DMUG + Dicy | 68KGB-6 No Finish |
| Smoothness Appearance | 3 HLTD | 1.9 | 2.3 | 2.1 | 2.5 | 2.2 | 1.0 |
| % Dimensional Change 3 HLTD | Warp | −1.9 | −2.1 | −2.8 | −1.6 | −2.1 | −5.1 |
| | Filling | −1.2 | −1.1 | −1.6 | −1.2 | −1.0 | −1.3 |
| Tensile, lbs. | Warp | 85.8 | 101.8 | 100.9 | 92.1 | 95.0 | 130.8 |
| | Filling | 29.4 | 36.6 | 37.6 | 35.7 | 36.7 | 51.5 |
| Tear, lbs. | Warp | DNT | DNT | 9.3 | DNT | 7.5 | 3.8 |
| | Filling | 3.0 | 4.2 | 4.4 | 3.5 | 3.7 | 1.7 |
| Warp Flex Abrasion | 3 HLTD | 794 | 1294 | 1612 | 1134 | 1645 | 545 |
| Whiteness Index | CIE | 90 | 83 | 86 | 84 | 83 | 88 |
| Wrinkle Recovery | AATCC 128 | 2.0 | 1.7 | 1.4 | 2.0 | 1.8 | 1.3 |
| CRA, ° (w + f) | 3 HLTD | 167 | 163 | 158 | 186 | 187 | 112 |
| % Nitrogen | Original | 0.30 | 0.67 | 0.89 | 0.97 | 1.25 | 0.03 |
| | Washed | 0.21 | 0.39 | 0.42 | 0.61 | 0.62 | N/A |
| | % Fixation | 66.2 | 56.9 | 45.6 | 61.3 | 48.5 | N/A |

Key to abbreviations:
HLTD = Home Laundry/Tumble Drying cycles.
CRA = Crease Recovery Angle.
DNT = Did Not Tear (samples tore in the traverse direction).

TABLE 14C

Physical Test Results-100% Cotton Shirting (80/2 Pinpoint Oxford)
(Fabric C-Liquid Ammonia Pre-Treated Only)

| Sample ID Description | | 68KGB-1 DMDHEU Control | 68KGB-2 200 g/L DMUG | 68KGB-3 200 g/L DMUG + 5 Dicy | 68KGB-4 300 g/L DMUG | 68KGB-5 300 g/L DMUG + 5 Dicy | 68KGB-6 No Finish |
|---|---|---|---|---|---|---|---|
| Smoothness Appearance | 3 HLTD | 2.6 | 2.8 | 2.7 | 3.1 | 2.8 | 2.1 |
| % Dimensional Change 3 HLTD | Warp | −2.2 | −2.3 | −2.5 | −1.8 | −2.4 | −5.4 |
| | Filling | −2.2 | −2.3 | −2.8 | −2.0 | −1.9 | 0.2 |
| Tensile, lbs. | Warp | 87.2 | 96.8 | 103.5 | 94.7 | 102.5 | 134.7 |
| | Filling | 31.7 | 36.1 | 39.1 | 33.5 | 37.2 | 47.9 |
| Tear, lbs. | Warp | DNT | 10.1 | DNT | DNT | DNT | 4.7 |
| | Filling | 3.1 | 4.6 | 5.7 | 4.0 | 4.7 | 2.2 |
| Warp Flex Abrasion | 3 HLTD | 984 | 1456 | 1563 | 1343 | 1625 | 577 |
| Whiteness Index | CIE | 87 | 86 | 89 | 87 | 86 | 85 |
| Wrinkle Recovery | AATCC 128 | 1.6 | 1.7 | 1.8 | 2.0 | 1.8 | 1.6 |
| CRA, ° (w + f) | 3 HLTD | 193 | 203 | 203 | 224 | 215 | 152 |
| % Nitrogen | Original | 0.26 | 0.52 | 0.84 | 0.96 | 1.10 | 0.03 |
| | Washed | 0.19 | 0.36 | 0.41 | 0.54 | 0.62 | N/A |
| | % Fixation | 71.8 | 68.0 | 46.9 | 54.8 | 55.8 | N/A |

Key to abbreviations:
HLTD = Home Laundry/Tumble Drying cycles.
CRA = Crease Recovery Angle.
Note:
DNT = Did Not Tear (samples tore in the traverse direction).

Referring to the finish formulas shown in Table 13 and the physical test results for the treated fabric samples in Table 14C (liquid ammonia pre-treated only fabric), the smoothness ratings for all non-formaldehyde trials using the DMUG reactant were higher than the DMDHEU Control. The addition of dicyandiamide to the finish with 200 g/L DMUG did not change the smoothness rating; however, there was a small decrease in smoothness with the finish containing 300 g/L DMUG when dicyandiamide was added. Tensile and tear strength were generally higher for the DMUG finishes than the DMDHEU Control. The addition of dicyandiamide resulted in increases in tensile and tear strength in the finishes with both concentrations of DMUG (200 and 300 g/L). Flex abrasion was higher with all DMUG finishes than the DMDHEU Control, and the addition of dicyandiamide resulted in further improvements in flex abrasion. Note that the wrinkle recovery test is a very severe test for woven cotton fabrics, so all results were low (2.0 or less.) Whiteness indices for all non-formaldehyde finishes were all acceptable.

Summarizing all physical test results for all fabrics in the "68KGB" trials (Tables 13, 14A, 14B, and 14C), it should be noted that smoothness ratings were overall highest for the liquid ammonia pre-treated only fabric (Fabric C), followed by the mercerized/liquid ammonia pre-treated fabric (Fabric A) and then the mercerized only fabric (Fabric B). In some cases, especially with the higher concentration of DMUG (300 g/L), there was some decrease in smoothness ratings with the addition of dicyandiamide. There were some concerns that the concentration of dicyandiamide may have been too high at 5 g/L. In addition, the dry/curing times may have been too short. It was decided to repeat the trials with some adjustments in formulas and dry/cure times on Fabrics B and C; see Tables 15, 16A, and 16B below for the follow-up trials.

TABLE 15

Finish Formulas for 100% Cotton Shirting (80/2 Pinpoint Oxford)

| grams per kg | 70KGB-1 DMDHEU Control | 70KGB-2 200 g/L DMUG | 70KGB-3 200 g/L DMUG + 3 Dicy | 70KGB-4 300 g/L DMUG | 70KGB-5 300 g/L DMUG + 3 Dicy | 70KGB-6 No Finish |
|---|---|---|---|---|---|---|
| Water | 868 | 738 | 735 | 628 | 625 | No Finish |
| Dicyandiamide | — | — | 3 | — | 3 | |
| Wetting agent | 2 | 2 | 2 | 2 | 2 | |
| Hi-conc DMDHEU reactant (~75% active) | 60 | — | — | — | — | |
| Modified DMUG reactant (~40% active) | — | 200 | 200 | 300 | 300 | |
| Catalyst for DMDHEU reactant ($MgCl_2$ blended with citric acid) | 30 | — | — | — | — | |

TABLE 15-continued

| Finish Formulas for 100% Cotton Shirting (80/2 Pinpoint Oxford) | | | | | | |
|---|---|---|---|---|---|---|
| grams per kg | 70KGB-1 DMDHEU Control | 70KGB-2 200 g/L DMUG | 70KGB-3 200 g/L DMUG + 3 Dicy | 70KGB-4 300 g/L DMUG | 70KGB-5 300 g/L DMUG + 3 Dicy | 70KGB-6 No Finish |
| Catalyst for DMUG reactant ($MgCl_2$ blended with an organic acid) | — | 20 | 20 | 30 | 30 | |
| High density polyethylene | 10 | 10 | 10 | 10 | 10 | |
| Amino silicone softener | 30 | 30 | 30 | 30 | 30 | |
| Bath pH (meter) Record only | 4.33 | 3.54 | 3.59 | 3.39 | 3.45 | N/A |
| Dry/Cure Temperature, ° C. | 171 | 160 | 160 | 160 | 160 | |
| Dry/Cure Time, seconds | 105 | 90 | 90 | 90 | 90 | |
| Tenter speed, m/min | 5.5 | 6.5 | 6.5 | 6.5 | 6.5 | |

Procedure: Trials were conducted on a pilot scale tenter frame. Padding was performed at 65 psi (wet pick-up was 55-60% wet pick-up). The fabrics were dry/cured at the times and temperatures shown in Table 15.

TABLE 16A

| Physical Test Results-100% Cotton Shirting (80/2 Pinpoint Oxford) (Fabric B-Mercerized Only) | | | | | | | |
|---|---|---|---|---|---|---|---|
| Sample ID Description | | 70KGB-1B DMDHEU Control | 70KGB-2B 200 g/L DMUG | 70KGB-3B 200 g/L DMUG + Dicy | 70KGB-4B 300 g/L DMUG | 70KGB-5B 300 g/L DMUG + Dicy | 70KGB-6B No Finish |
| Smoothness | 3 HLTD | 1.4 | 2.2 | 2.1 | 2.4 | 2.3 | 1.1 |
| % Dimensional Change 3 HLTD | Warp | −2.0 | −2.3 | −2.6 | −2.1 | −2.0 | −5.2 |
| | Filling | −2.7 | −3.0 | −3.2 | −2.3 | −2.5 | −0.8 |
| Tensile, lbs. | Warp | 89.0 | 109.1 | 117.1 | 107.6 | 109.9 | 152.6 |
| | Filling | 28.3 | 37.9 | 38.4 | 37.4 | 36.4 | 54.2 |
| Tear, lbs. | Warp | DNT | DNT | DNT | DNT | DNT | DNT |
| | Filling | 2.8 | 3.8 | 4.0 | 3.3 | 3.9 | 1.7 |
| Warp Flex Abrasion | 3 HLTD | 489 | 2647 | 2916 | 1960 | 2499 | 683 |
| Whiteness Index | CIE | 81 | 80 | 80 | 77 | 77 | 84 |
| Martindale Abrasion | 3 HLTD | 15000 | >20000 | >20000 | >20000 | >20000 | >20000 |
| CRA, ° (w + f) | 3 HLTD | 224 | 210 | 210 | 222 | 225 | 147 |

Key to abbreviations:

HLTD = Home Laundry/Tumble Drying cycles.

CRA = Crease Recovery Angle.

Note:

DNT = Did Not Tear (samples tore in the traverse direction).

Referring to the finish formulas shown in Table 15 and the physical test results for the treated fabric samples in Table 16A (mercerized only fabric), the smoothness ratings for all non-formaldehyde trials using the DMUG reactant were higher than the DMDHEU Control. The addition of dicyandiamide did not have much effect on smoothness ratings with both concentrations of DMUG (200 and 300 g/L). Tensile and tear strength were generally higher for the DMUG finishes than the DMDHEU Control. The addition of dicyandiamide resulted in increases in tensile and tear strength in the finishes with both concentrations of DMUG. Flex abrasion was higher with all DMUG finishes than the DMDHEU Control, and the addition of dicyandiamide resulted in further improvements in flex abrasion. Martindale abrasion values were higher with all DMUG finishes than the DMDHEU Control. Since the Martindale test was stopped at 20,000 cycles, it could not be determined if the dicyandiamide made any improvements in Martindale abrasion. Whiteness indices with 200 g/L were acceptable; at 300 g/L DMUG there was a reduction in whiteness, but the degree of yellowing was not too excessive.

TABLE 16B

Physical Test Results-100% Cotton Shirting (80/2 Pinpoint Oxford)
(Fabric C-Liquid Ammonia Pre-Treated Only)

| Sample ID Description | | 70KGB-1B DMDHEU Control | 70KGB-2B 200 g/L DMUG | 70KGB-3B 200 g/L DMUG + Dicy | 70KGB-4B 300 g/L DMUG | 70KGB-5B 300 g/L DMUG + Dicy | 70KGB-6B No Finish |
|---|---|---|---|---|---|---|---|
| Smoothness | 3 HLTD | 2.4 | 2.9 | 2.9 | 3.3 | 3.0 | 1.5 |
| % Dimensional Change 3 HLTD | Warp | −2.0 | −2.0 | −2.6 | −2.2 | −2.2 | −5.5 |
| | Filling | −4.3 | −4.3 | −4.6 | −4.3 | −4.9 | −0.2 |
| Tensile, lbs. | Warp | 94.3 | 113.6 | 118.3 | 116.6 | 114.3 | 160.1 |
| | Filling | 34.3 | 39.1 | 41.6 | 35.9 | 36.1 | 54.7 |
| Tear, lbs. | Warp | DNT | DNT | DNT | DNT | DNT | DNT |
| | Filling | 2.8 | 4.5 | 5.0 | 3.8 | 3.8 | 2.5 |
| Warp Flex Abrasion | 3 HLTD | 1815 | 2968 | 3553 | 2374 | 2271 | 829 |
| Whiteness Index | CIE | 82 | 81 | 82 | 80 | 82 | 86 |
| Martindale Abrasion | 3 HLTD | >20000 | >20000 | >20000 | >20000 | >20000 | >20000 |
| CRA, ° (w + f) | 3 HLTD | 235 | 254 | 249 | 263 | 255 | 184 |

Key to abbreviations:
HLTD = Home Laundry/Tumble Drying cycles.
CRA = Crease Recovery Angle.
Note:
DNT = Did Not Tear (samples tore in the traverse direction).

Referring to the finish formulas shown in Table 15 and the physical test results for the treated fabric samples in Table 16B (liquid ammonia pre-treated only fabric), the smoothness ratings for all non-formaldehyde trials using the DMUG reactant were higher than the DMDHEU Control. The addition of dicyandiamide to the finish with 200 g/L DMUG did not change the smoothness rating; however, there was a small decrease in smoothness with the finish containing 300 g/L DMUG when dicyandiamide was added. There were small gains in tensile strength, tear strength, and flex abrasion in the finishes with 200 g/L DMUG when dicyandiamide was added; however, with 300 g/L DMUG, dicyandiamide did not affect these properties to a significant degree. Since all Martindale abrasion tests were stopped at 20,000 cycles, no differences in results could be determined. Whiteness index was acceptable with all DMUG finishes.

In summary for all "70KGB" trials on the shirting fabrics as detailed in Tables 15, 16A, and 16B, the overall results for smoothness did not improve much with the adjustments in dry/curing times as compared to the "68KGB" trials shown in Tables 13, 14A, 14B, and 14C.

TABLE 17

Finish Formulas for Cotton Interlock Knit Fabric, Set "34GW"

| grams per kg | 34GW-1 DMDHEU Control | 34GW-2 100 DMUG | 34GW-3 100 DMUG + 0.5 Dicy | 34GW-4 100 DMUG + Dicy | 34GW-5 100 DMUG + 1.5 Dicy | 34GW-6 200 DMUG | 34GW-7 200 DMUG + 1 Dicy | 34GW-8 200 DMUG + 2 Dicy | 34GW-9 200 DMUG + 3 Dicy | 34GW-10 Softener Only | 34GW-11 No Finish |
|---|---|---|---|---|---|---|---|---|---|---|---|
| Warm Water | 913 | 848 | 847.5 | 847 | 846.5 | 738 | 737 | 736 | 735 | 958 | — |
| Dicyandiamide | — | — | 0.5 | 1 | 1.5 | — | 1 | 2 | 3 | — | — |
| Wetting agent | 2 | 2 | 2 | 2 | 2 | 2 | 2 | 2 | 2 | 2 | — |
| Hi-conc DMDHEU reactant (~75% active) | 30 | — | — | — | — | — | — | — | — | — | — |
| Catalyst for DMDHEU reactant ($MgCl_2$) | 15 | — | — | — | — | — | — | — | — | — | — |
| Modified DMUG reactant (~40% active) | — | 100 | 100 | 100 | 100 | 200 | 200 | 200 | 200 | — | — |
| Catalyst for DMUG reactant ($MgCl_2$ blended with an organic acid) | — | 10 | 10 | 10 | 10 | 20 | 20 | 20 | 20 | — | — |
| High density polyethylene | 10 | 10 | 10 | 10 | 10 | 10 | 10 | 10 | 10 | 10 | — |
| Hydrophilic silicone softener | 30 | 30 | 30 | 30 | 30 | 30 | 30 | 30 | 30 | 30 | — |

TABLE 17-continued

Finish Formulas for Cotton Interlock Knit Fabric, Set "34GW"

| grams per kg | 34GW-1 DMDHEU Control | 34GW-2 100 DMUG | 34GW-3 100 DMUG + 0.5 Dicy | 34GW-4 100 DMUG + Dicy | 34GW-5 100 DMUG + 1.5 Dicy | 34GW-6 200 DMUG | 34GW-7 200 DMUG + 1 Dicy | 34GW-8 200 DMUG + 2 Dicy | 34GW-9 200 DMUG + 3 Dicy | 34GW-10 Softener Only | 34GW-11 No Finish |
|---|---|---|---|---|---|---|---|---|---|---|---|
| Bath pH | 4.7 | 3.8 | 3.7 | 3.8 | 3.8 | 3.6 | 3.6 | 3.6 | 3.5 | 6.9 | N/A |
| % Wet pick-up | 121% | 119% | 120% | 121% | 120% | 122% | 121% | 120% | 120% | 114% | N/A |

Procedure: Pre-mark fabric samples to dimensions on pin frames, pad-at 0.7 m/min, 30 psi, 1 dips and 1 nip (target wet pick-up = 110-120%), pin fabrics on marks on fabric, and dry/cure-at 160° C. for 90 seconds in a continuous lab oven.

TABLE 18

Physical Test Results - Cotton Interlock Knit Fabric, Set "34GW"

| Sample ID | Description | Smoothness 3 HLTD | % Dimensional Change, 3 HLTD Length | Width | Burst psi |
|---|---|---|---|---|---|
| 34GW-1 | DMDHEU Control | 3.3 | −6.8 | −1.2 | 77 |
| 34GW-2 | 100 DMUG | 3.5 | −4.0 | −1.8 | 71 |
| 34GW-3 | 100 DMUG + 0.5 Dicy | 3.4 | −4.0 | −2.1 | 83 |
| 34GW-4 | 100 DMUG + 1 Dicy | 3.8 | −4.2 | −1.2 | 80 |
| 34GW-5 | 100 DMUG + 1.5 Dicy | 3.6 | −5.1 | −2.1 | 83 |
| 34GW-6 | 200 DMUG | 3.8 | −3.4 | −1.6 | 67 |
| 34GW-7 | 200 DMUG + 1 Dicy | 3.8 | −3.7 | −1.8 | 72 |
| 34GW-8 | 200 DMUG + 2 Dicy | 3.7 | −3.9 | −1.8 | 77 |
| 34GW-9 | 200 DMUG + 3 Dicy | 3.7 | −4.2 | −2.1 | 80 |

TABLE 18-continued

Physical Test Results - Cotton Interlock Knit Fabric, Set "34GW"

| Sample ID | Description | Smoothness 3 HLTD | % Dimensional Change, 3 HLTD Length | Width | Burst psi |
|---|---|---|---|---|---|
| 34GW-10 | Softener Only | 3.4 | −8.9 | −0.6 | 96 |
| 34GW-11 | No Finish | 3.0 | −8.8 | 0.7 | 104 |

Key to abbreviation:
HLTD = Home Laundry/Tumble Drying cycles.

Referring to the finish formulas shown in Table 17 and the physical test results for the treated fabric samples in Table 18, the 100 g/L DMUG formula (34GW-2) had slightly better fabric smoothness compared to control finish. The addition of varying amounts of dicyandiamide (0.5, 1.0, and 1.5 g/L) to formula 34GW-2 tended to improve burst strength. With 200 g/L DMUG in the formulation (34GW-6) smoothness was improved as compared to the 100 g/L DMUG formula (34GW-2), but burst strength was decreased. Adding varying amounts of dicyandiamide (1, 2, and 3 g/L) to the 200 g/L DMUG formula (34GW-7, 34GW-8, and 34GW-9) tended to increase burst strength without changing the smoothness.

TABLE 19

Finish Formulas for Cotton Interlock Knit Fabric, Set "37GW"

| grams per kg | 37GW-1 DMDHEU Control | 37GW-2 100 DMUG | 37GW-3 100 DMUG + 1 Dicy | 37GW-4 200 DMUG | 37GW-5 200 DMUG + 2 Dicy | 37GW-6 No Finish |
|---|---|---|---|---|---|---|
| Warm Water | 913 | 848 | 847 | 738 | 736 | — |
| Dicyandiamide | — | — | 1 | — | 2 | — |
| Wetting agent | 2 | 2 | 2 | 2 | 2 | — |
| Hi-conc DMDHEU reactant (~75% active) | 30 | — | — | — | — | — |
| Catalyst for DMDHEU reactant ($MgCl_2$) | 15 | — | — | — | — | — |
| Modified DMUG reactant (~40% active) | — | 100 | 100 | 200 | 200 | — |
| Catalyst for DMUG reactant ($MgCl_2$ blended with an organic acid) | — | 10 | 10 | 20 | 20 | — |
| High density polyethylene | 10 | 10 | 10 | 10 | 10 | — |
| Hydrophilic silicone softener | 30 | 30 | 30 | 30 | 30 | — |
| Bath pH | 5.1 | 3.9 | 3.8 | 3.7 | 3.7 | — |
| % Wet pick-up | 121% | 121% | 120% | 116% | 125% | N/A |

Procedure: Pre-mark fabric samples to dimensions on pin frames, pad-at 0.7 m/min, 30 psi, 1 dips and 1 nip (target wet pick-up = 110-120%), pin fabrics on marks on fabric, and dry/cure at 160° C. in a continuous lab oven. Samples "A" were dry/cured for 90 seconds; Samples "B" were dry/cured for 60 seconds.

TABLE 20

Physical Test Results - Cotton Interlock Knit Fabric, Set "37GW"

| Sample ID | Description | Smoothness 3 HLTD | % Dimensional Change, 3 HLTD Length | Width | Burst psi |
|---|---|---|---|---|---|
| 37GW-1A | DMDHEU Control, 90 s | 3.3 | −6.1 | −1.2 | 73 |
| 37GW-2A | 100 DMUG, 90 s | 3.5 | −4.7 | −0.5 | 71 |
| 37GW-3A | 100 DMUG + 1 Dicy, 90 s | 3.3 | −4.6 | −0.5 | 83 |
| 37GW-4A | 200 DMUG, 90 s | 3.6 | −2.9 | −0.7 | 67 |
| 37GW-5A | 200 DMUG + 2 Dicy, 90 s | 3.6 | −4.5 | 0.0 | 70 |
| 37GW-1B | DMDHEU Control, 120 s | 3.4 | −1.0 | −0.8 | 61 |
| 37GW-2B | 100 DMUG, 120 s | 3.3 | −3.8 | 0.1 | 71 |
| 37GW-3B | 100 DMUG + 1 Dicy, 120 s | 3.5 | −4.0 | −0.9 | 73 |
| 37GW-4B | 200 DMUG, 120 s | 3.8 | −2.9 | −0.9 | 65 |

TABLE 20-continued

Physical Test Results - Cotton Interlock Knit Fabric, Set "37GW"

| Sample ID | Description | Smoothness 3 HLTD | % Dimensional Change, 3 HLTD Length | Width | Burst psi |
|---|---|---|---|---|---|
| 37GW-5B | 200 DMUG + 2 Dicy, 120 s | 3.6 | −3.0 | −0.3 | 69 |
| 37GW-6 | No Finish | 2.4 | −8.1 | 1.3 | 106 |

Key to abbreviation:
HLTD = Home Laundry/Tumble Drying cycles.

Referring to the finish formulas shown in Table 19 and the physical test results for the treated fabric samples in Table 20, the longer curing time only gave slight, if any, improvements in smoothness. The increased curing time, however, tended to impair burst strength. As observed in Set "34GW" (Tables 17 and 18), adding dicyandiamide tended to improve burst strength.

TABLE 21

Finish Formulas for Cotton Interlock Knit Fabric, Set "50GW"

| grams per kg | 50GW-1 DMDHEU Control | 2 100 DMUG | 3 100 DMUG + 2 Dicy | 4 100 DMUG + 5 Dicy | 5 100 DMUG + 10 Dicy | 6 100 DMUG + 20 Dicy | 7 100 DMUG + 10 CC | 8 100 DMUG + 20 CC | 9 100 DMUG + 10 EU | 10 100 DMUG + 20 EU | 11 No Finish |
|---|---|---|---|---|---|---|---|---|---|---|---|
| Warm Water | 913 | 848 | 838 | 823 | 798 | 748 | 828 | 808 | 823 | 798 | — |
| Dicyandiamide (20%) | — | — | 10 | 25 | 50 | 100 | — | — | — | — | — |
| Choline Chloride (50%) | — | — | — | — | — | — | 20 | 40 | — | — | — |
| Ethyleneurea (40%) | — | — | — | — | — | — | — | — | 25 | 50 | — |
| Wetting agent | 2 | 2 | 2 | 2 | 2 | 2 | 2 | 2 | 2 | 2 | — |
| Hi-conc DMDHEU reactant (~75% active) | 30 | — | — | — | — | — | — | — | — | — | — |
| Catalyst for DMDHEU reactant ($MgCl_2$) | 15 | — | — | — | — | — | — | — | — | — | — |
| Modified DMUG reactant (~40% active) | — | 100 | 100 | 100 | 100 | 100 | 100 | 100 | 100 | 100 | — |
| Catalyst for DMUG reactant ($MgCl_2$ blended with an organic acid) | — | 10 | 10 | 10 | 10 | 10 | 10 | 10 | 10 | 10 | — |
| High density polyethylene | 10 | 10 | 10 | 10 | 10 | 10 | 10 | 10 | 10 | 10 | — |
| Hydrophilic silicone softener | 30 | 30 | 30 | 30 | 30 | 30 | 30 | 30 | 30 | 30 | — |
| Bath pH (meter) | | | | | | | | | | | |
| Actual pH | 4.7 | 3.7 | 3.8 | 3.8 | 3.8 | 3.9 | 3.7 | 3.8 | 4.2 | 4.5 | N/A |
| % Wet pick-up | 124% | 123% | 122% | 126% | 128% | 119% | 122% | 122% | 125% | 122% | N/A |

Procedure: Pre-mark fabric samples to dimensions on pin frames, pad-at 0.7 m/min, 30 psi, 1 dips and 1 nip (target wet pick-up = 110-120%), pin fabrics on marks on fabric, and dry/cure at 160° C. for 90 seconds in a continuous lab oven.

TABLE 22

Physical Test Results - Cotton Interlock Knit Fabric, Set "50GW"

| Sample ID | Description | Smoothness 3 HLTD | % Dimensional Change, 3 HLTD Length | Width | Burst psi |
|---|---|---|---|---|---|
| 50GW-1 | DMDHEU Control | 3.3 | −4.1 | 1.6 | 73 |
| 50GW-2 | 100 DMUG | 3.6 | −2.1 | 1.4 | 72 |
| 50GW-3 | 100 DMUG + 2 Dicy | 3.4 | −3.3 | 0.5 | 84 |
| 50GW-4 | 100 DMUG + 5 Dicy | 3.2 | −5.0 | 1.0 | 89 |
| 50GW-5 | 100 DMUG + 10 Dicy | 3.2 | −6.0 | 1.6 | 91 |
| 50GW-6 | 100 DMUG + 20 Dicy | 3.2 | −7.1 | 1.3 | 93 |
| 50GW-7 | 100 DMUG + 10 CC | 3.4 | −1.9 | 1.1 | 78 |
| 50GW-8 | 100 DMUG + 20 CC | 3.4 | −2.0 | 1.0 | 76 |
| 50GW-9 | 100 DMUG + 10 EU | 3.3 | −3.2 | 1.5 | 82 |
| 50GW-10 | 100 DMUG + 20 EU | 3.1 | −3.9 | 1.8 | 94 |
| 50GW-11 | No Finish | 2.9 | −8.6 | 2.6 | 104 |

Key to abbreviation:
HLTD = Home Laundry/Tumble Drying cycles.

Referring to the finish formulas shown in Table 21 and the physical test results for the treated fabric samples in Table 22, note that the DMDHEU Control (50GW-1) and the non-formaldehyde resin (50GW-2) provided moderate improvements in smoothness as compared to the unfinished sample. Both finishes did reduce shrinkage to a substantial degree. The non-formaldehyde resin provided somewhat better smoothness and lower shrinkage than the DMDHEU Control; the burst strength was nearly equal for both finishes.

In Set "50GW" (Tables 21 and 22), the addition of dicyandiamide progressively improved burst strength, but the smoothness ratings and shrinkage control gradually worsened. The optimum amount of dicyandiamide needed to increase burst strength, while maintaining smoothness and shrinkage, appears to be in the range of 2 to 5 g/kg (0.2-0.5% on weight of bath). Choline chloride had very little, if any, effect on any of the physical properties. Ethyleneurea did improve burst strength, but as the amount was increased from 10 to 20 g/kg, the smoothness decreased to nearly the same value as the unfinished fabric and the shrinkage increased.

TABLE 23

Finish Formulas for Cotton Interlock Knit Fabric, Set "51GW"

| grams per kg | 1 DMDHEU Control KR | 2 200 DMUG | 3 200 DMUG + 2 Dicy | 4 200 DMUG + 5 Dicy | 5 200 DMUG + 10 Dicy | 6 200 DMUG + 20 Dicy | 7 200 DMUG + 10 CC | 8 200 DMUG + 20 CC | 9 200 DMUG + 10 EU | 10 200 DMUG + 20 EU | 11 No Finish |
|---|---|---|---|---|---|---|---|---|---|---|---|
| Warm Water | 913 | 738 | 728 | 713 | 688 | 638 | 718 | 698 | 713 | 688 | — |
| Dicyandiamide (20%) | — | — | 10 | 25 | 50 | 100 | — | — | — | — | — |
| Choline Chloride (50%) | — | — | — | — | — | — | 20 | 40 | — | — | — |
| Ethyleneurea (40%) | — | — | — | — | — | — | — | — | 25 | 50 | — |
| Wetting agent | 2 | 2 | 2 | 2 | 2 | 2 | 2 | 2 | 2 | 2 | — |
| Hi-conc DMDHEU reactant (~75% active) | 30 | — | — | — | — | — | — | — | — | — | — |
| Catalyst for DMDHEU reactant ($MgCl_2$) | 15 | — | — | — | — | — | — | — | — | — | — |
| Modified DMUG reactant (~40% active) | — | 200 | 200 | 200 | 200 | 200 | 200 | 200 | 200 | 200 | — |
| Catalyst for DMUG reactant ($MgCl_2$ blended with an organic acid) | — | 20 | 20 | 20 | 20 | 20 | 20 | 20 | 20 | 20 | — |
| High density polyethylene | 10 | 10 | 10 | 10 | 10 | 10 | 10 | 10 | 10 | 10 | — |
| Hydrophilic silicone softener | 30 | 30 | 30 | 30 | 30 | 30 | 30 | 30 | 30 | 30 | — |
| Bath pH (meter) | | | | | | | | | | | |
| Actual pH | 4.7 | 3.6 | 3.6 | 3.6 | 3.6 | 3.7 | 3.6 | 3.6 | 4.0 | 4.6 | N/A |
| % Wet pick-up | 109% | 115% | 114% | 118% | 118% | 119% | 111% | 112% | 112% | 114% | N/A |

Procedure: Pre-mark fabric samples to dimensions on pin frames, pad-at 0.7 m/min, 30 psi, 1 dips and 1 nip (target wet pick-up = 110-120%), pin fabrics on marks on fabric, and dry/cure at 160° C. for 90 seconds in a continuous lab oven.

TABLE 24

Physical Test Results - Cotton Interlock Knit Fabric, Set "51GW"

| Sample | | Smoothness | % Dimensional Change 3 HLTD | | Burst |
|---|---|---|---|---|---|
| ID | Description | 3 HLTD | Length | Width | psi |
| 51GW-1 | DMDHEU Control | 3.5 | −7.5 | 1.4 | 75 |
| 51GW-2 | 200 DMUG | 3.9 | −3.3 | −0.4 | 72 |
| 51GW-3 | 200 DMUG + 2 Dicy | 3.9 | −4.8 | −0.8 | 78 |
| 51GW-4 | 200 DMUG + 5 Dicy | 3.7 | −6.7 | −0.1 | 87 |
| 51GW-5 | 200 DMUG + 10 Dicy | 3.5 | −7.2 | 0.2 | 96 |
| 51GW-6 | 200 DMUG + 20 Dicy | 3.2 | −9.4 | 1.7 | 100 |
| 51GW-7 | 200 DMUG + 10 CC | 3.9 | −4.0 | −0.2 | 74 |
| 51GW-8 | 200 DMUG + 20 CC | 3.9 | −4.5 | 0.2 | 71 |
| 51GW-9 | 200 DMUG + 10 EU | 4.0 | −4.6 | 1.2 | 75 |
| 51GW-10 | 200 DMUG + 20 EU | 3.5 | −8.7 | 1.7 | 94 |
| 51GW-11 | No Finish | 3.3 | −8.2 | 4.1 | 110 |

Key to abbreviation:
HLTD = Home Laundry/Tumble Drying cycles.

Referring to the finish formulas shown in Table 23 and the physical test results for the treated fabric samples in Table 24, the non-formaldehyde finish (51GW-2) provided better smoothness than its analog in Set "50GW" because the amount of resin was doubled. Interestingly, increasing the amount of non-formaldehyde resin did not impair burst strength. As in Set "50GW", adding dicyandiamide to the non-formaldehyde finish increased burst strength, but the smoothness ratings and shrinkage control were progressively impaired.

As in Set 50GW, choline chloride had little effect, and ethyleneurea improved burst strength but at the sacrifice of smoothness and shrinkage control. Note the bath pH increased with the more of the ethyleneurea, which may simply result in less curing. With dicyandiamide the bath pH was not affected, even at the highest concentrations.

As stated in the beginning of Section B of the Detailed Description, these experiments support the statement, "it is critical that the additives be used in an optimized finish at the correct concentrations". The amount of each additive required is dependent on the desired effect; for example, if strength increase is the desired goal, and smoothness/shrinkage control are secondary, it is possible that somewhat higher amounts of each additive could be utilized in the formulation. However, if smoothness/shrinkage cannot be sacrificed, then less of each additive would be required.

REFERENCES

All publications, patent applications, patents, and other references mentioned in the specification are indicative of the level of those skilled in the art to which the presently disclosed subject matter pertains. All publications, patent applications, patents, and other references (e.g., websites, databases, etc.) mentioned in the specification are herein incorporated by reference in their entirety to the same extent as if each individual publication, patent application, patent, and other reference was specifically and individually indicated to be incorporated by reference. It will be understood that, although a number of patent applications, patents, and other references are referred to herein, such reference does not constitute an admission that any of these documents forms part of the common general knowledge in the art. In case of a conflict between the specification and any of the incorporated references, the specification (including any amendments thereof, which may be based on an incorporated reference), shall control. Standard art-accepted meanings of terms are used herein unless indicated otherwise. Standard abbreviations for various terms are used herein.

Tomasino, C., *Chemistry & Technology of Fabric Preparation & Finishing*, copyright 1992, NCSU Copy Center, North Carolina State University, Raleigh, N.C.

Vigo, T. L., *Textile Processing and Properties Preparation, Dyeing, Finishing and Performance*, copyright 1994, Elsevier Science B.V., Amsterdam, The Netherlands.

Greeson Jr., H. K., Phillips, K. J., and Turner, J. D., "Tough Cotton: A Novel Approach to Durable Press Finishing," *AATCC Review*, March 2005, Vol. 5 Issue 3, pp. 13-16.

Greeson Jr., H. K.; Rowe, James E., "Tough Cotton Finish for Shirting," *AATCC Review*. March 2009, Vol. 9 Issue 3, pp. 30-32.

U.S. Pat. No. 5,707,404, for Formaldehyde Free Method For Imparting Permanent Press Properties To Cotton And Cotton Blends, Westpoint Stevens, Inc., Andrews; George A.; Peterson; Joseph; Hough; William, Jan. 13, 1998.

U.S. Pat. No. 8,399,692, for Epichlorohydrin, Manufacturing Process And Use, Solvay (Societe Anonyme) Krafft Philippe; Gilbeau Patrick; Balthasart Dominique; Boulos Noel, Mar. 19, 2013.

U.S. Pat. No. 4,331,438, for Process For Eliminating Free Formaldehyde In Textile Materials Treated With Dimethylolated Carbamates, BASF Wyandotte Corporation, Pai; Panemangalore S., May 25, 1982.

U.S. Pat. No. 3,957,431, for Process For Easy-Care Finishing Cellulosics, BASF Aktiengesellschaft, Pai; Panemangalore S.; Petersen; Harro; Klippel; Friedrich, May 18, 1976.

U.S. Pat. No. 3,232,691, for Dyeing With Copolymeric Dyes And Crosslinking The Latter, BASF AG, Hans Wilhelm; Guenter Lange; Hans Weidinger, Feb. 1, 1966.

International Patent No. WO 2007/042380 A1, for Process for Finishing Textiles, Clariant International LTD, Jean Kyriazis, Georg Lang, Apr. 19, 2007.

U.S. Pat. No. 2,886,474, for Compositions For Binding Pigments, ROHM & HAAS, Kine Benjamin B.; Nuessle Albert C., May 12, 1959.

GB1142428A, Finishing Fibrous Material Containing or Consisting of Cellulose, BASF AG, Feb. 5, 1969.

GB769271A, Improvements in or Relating to Aqueous Coloring Compositions, ROHM & HAAS, Mar. 6, 1957.

GB769255A, Improvements in or Relating to Aqueous Coloring Compositions and Preparation Thereof, ROHM & HAAS, Mar. 6, 1957.

GB769252A, Improvements in or Relating to Textile Coloring Compositions, ROHM & HAAS, Mar. 6, 1957.

GB768883A, Improvements in or Relating to Textile Coloring Compositions, ROHM & HAAS, Feb. 20, 1957.

European Chemicals Agency (ECHA), available at: www.echa.europa.eu/documents/10162/13641/formaldehyde_review_report_en.pdf/5 51df4a2-28c4-2fa9-98ec-c8d53e2bf0fc (and references cited therein).

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A formulation for the durable press finishing of a cellulosic substrate, or a blend thereof, in a finish bath, the formulation comprising from about 3.0% to about 60.0% by weight of non-formaldehyde dimethylurea/glyoxal (DMUG), or an analog thereof, and from about 0.1% to about 4.0% by weight of dicyandiamide, wherein the percent by weight is given in terms of percent weight of the finish bath, and wherein the formulation is substantially free of dimethyloldihydroxyethyleneurea (DMDHEU).

2. The formulation of claim 1, further comprising from about 0.5% to about 8.0% of a polyethylene softener.

3. The formulation of claim 2, wherein the polyethylene softener is selected from the group consisting of a nonionic polyethylene softener, a cationic polyethylene softener, and combinations thereof.

4. The formulation of claim 1, further comprising amino-functional silicone softener with an amino-functional silicone softener which is present at a concentration up to about 6.0%.

5. The formulation of claim 1, further comprising an acid catalyst present at a concentration up to about 10.0% wherein the acid catalyst is selected from the group consisting of a Lewis acid catalyst, a Brønsted acid catalyst, or a blend thereof.

6. The formulation of claim 5, wherein the Lewis acid catalyst is selected from the group consisting of magnesium chloride, aluminum chloride, or magnesium sulfate.

7. The formulation of claim 5, comprising a blend of a Lewis acid catalyst and a Brønsted acid catalyst.

8. The formulation of claim 5, wherein the Brønsted acid catalyst is selected from the group consisting of citric acid, acetic acid, and hydroxyacetic acid.

9. The formulation of claim 1, further comprising an additive selected from the group consisting of a wetting agent, a fluorochemical repellent, a hand builder, and combinations thereof.

10. The formulation of claim 1, wherein the cellulosic substrate comprises a cellulosic fiber selected from the group consisting of cotton, jute, flax, hemp, ramie, regenerated cellulose products, including rayon (viscose), lyocell, modal, and blends thereof.

11. The formulation of claim 10, wherein the cellulosic substrate comprises cotton or a cotton blend.

12. The formulation of claim 10, further comprising one or more non-cellulosic fibers.

13. The formulation of claim 12, wherein the one or more non-cellulosic fibers is selected from the group consisting of a synthetic fiber and a non-cellulosic natural fiber.

14. The formulation of claim 13, wherein the non-cellulosic fiber is selected from the group consisting of a polyolefin, a polyester, nylon, polyvinyl, polyurethane, acetate, a mineral fiber, silk, wool, polylactic acid (PLA), polytrimethyl terephthalate (PTT), and combinations thereof.

15. The formulation of claim 1, wherein the cellulosic substrate comprises an article selected from the group consisting of a woven fabric, a knit fabric, a nonwoven fabric, a multilayer fabric, a garment, and a yarn.

16. The formulation of claim 1, comprising from about 10.0%-30.0% DMUG, about 0.1%-4.0% of dicyandiamide, and further comprising about 1.0%-5.0% polyethylene softener, about 1.0-5.0% amino-functional silicone, and about 1.0%-4.0% activated magnesium chloride.

17. The formulation of claim 16, further comprising a wetting agent.

18. The formulation of claim 1, further comprising from about 0.1% to about 4.0% by weight of one or more additives selected from the group consisting of choline chloride, ethyleneurea, propyleneurea, urea, dimethylurea, and combinations thereof.

19. A method for finishing a durable-press cellulosic substrate, or a blend thereof, in a finish bath, the method comprising applying a finishing formulation comprising from about 3.0% to about 60.0% by weight of non-formaldehyde dimethylurea/glyoxal (DMUG), or an analog thereof, and from about 0.1% to about 4.0% by weight of dicyandiamide, wherein the percent by weight is given in terms of percent weight of the finish bath, and wherein the formulation is substantially free of dimethyloldihydroxyethyleneurea (DMDHEU), to the substrate for a period of time at an elevated temperature.

20. The method of claim 19, further comprising from about 0.5% to about 8.0% of a polyethylene softener.

21. The method of claim 20, wherein the polyethylene softener is selected from the group consisting of a nonionic polyethylene softener, a cationic polyethylene softener, and combinations thereof.

22. The method of claim 19, further comprising amino-functional silicone softener with an amino-functional silicone softener which is present at a concentration up to about 6.0%.

23. The method of claim 19, further comprising an acid catalyst present at a concentration up to about 10.0% wherein the acid catalyst is selected from the group consisting of a Lewis acid catalyst, a Brønsted acid catalyst, or a blend thereof.

24. The method of claim 23, wherein the Lewis acid catalyst is selected from the group consisting of magnesium chloride, aluminum chloride, and magnesium sulfate.

25. The method of claim 23, comprising a blend of a Lewis acid catalyst and a Brønsted acid catalyst.

26. The method of claim 23, wherein the Brønsted acid catalyst is selected from the group consisting of citric acid, acetic acid, and hydroxyacetic acid.

27. The method of claim 19, further comprising an additive selected from the group consisting of a wetting agent, a fluorochemical repellent, a hand builder, and combinations thereof.

28. The method of claim 19, wherein the cellulosic substrate comprises a cellulosic fiber is selected from the group consisting of cotton, jute, flax, hemp, ramie, regenerated cellulose products, including rayon (viscose), lyocell, modal, and blends thereof.

29. The method of claim 28, wherein the cellulosic substrate comprises cotton or a cotton blend.

30. The method of claim 28, further comprising one or more non-cellulosic fibers.

31. The method of claim 30, wherein the one or more non-cellulosic fibers is selected from the group consisting of a synthetic fiber and a non-cellulosic natural fiber.

32. The method of claim 31, wherein the non-cellulosic fiber is selected from the group consisting of a polyolefin, a polyester, nylon, polyvinyl, polyurethane, acetate, a mineral fiber, silk, wool, polylactic acid (PLA), polytrimethyl terephthalate (PTT), and combinations thereof.

33. The method of claim 19, wherein the cellulosic substrate comprises an article selected from the group consisting of a woven fabric, a knit fabric, a nonwoven fabric, a multilayer fabric, a garment, and a yarn.

34. The method of claim 19, comprising from about 10.0%-30.0% DMUG, about 0.1%-4.0% of dicyandiamide, and further comprising about 1.0%-5.0% polyethylene softener, about 1.0-5.0% amino-functional silicone, and about 1.0%-4.0% activated magnesium chloride.

35. The method of claim 34, further comprising a wetting agent.

36. The method of claim 19, wherein the method is selected from the group consisting of a pre-cure and post-cure method.

37. The method of claim 19, wherein the method is selected from the group consisting of a garment-dip and a metered addition method.

38. The method of claim 19, wherein temperature has a range from about 140° C. to 200° C.

39. The method of claim 19, wherein the period of time has a range from about 10 seconds to about 10 minutes.

40. The method of claim 19, wherein the method comprises a wet pick-up method.

41. The method of claim 40, wherein the wet pick-up has a range from about 30% to about 120%.

42. The method of claim 19, wherein the finishing formulation further comprises from about 0.1% to about 4.0% by weight of one or more additives selected from the group consisting of choline chloride, ethyleneurea, propyleneurea, urea, dimethylurea, and combinations thereof.

* * * * *